US008360876B2

(12) United States Patent
Imachi et al.

(10) Patent No.: US 8,360,876 B2
(45) Date of Patent: Jan. 29, 2013

(54) NETWORKED GAME MACHINE, GAME INFORMATION DISPLAY AND GAME PROGRAM FOR MAHJONG GAME

(75) Inventors: Michiaki Imachi, Tokyo (JP); Takahiro Takeuchi, Tokyo (JP); Masahiro Nishiyama, Tokyo (JP); Yoshihiko Aramaki, Tokyo (JP); Kazuma Konishi, Tokyo (JP)

(73) Assignee: Konami Digital Entertainment Co., Ltd., Tokyo (JP)

( * ) Notice: Subject to any disclaimer, the term of this patent is extended or adjusted under 35 U.S.C. 154(b) by 227 days.

(21) Appl. No.: 12/657,720

(22) Filed: Jan. 26, 2010

(65) Prior Publication Data

US 2010/0197394 A1 Aug. 5, 2010

(30) Foreign Application Priority Data

Jan. 30, 2009 (JP) ..... 2009-020613

(51) Int. Cl.
*A63F 9/20* (2006.01)

(52) U.S. Cl. ..... 463/30; 463/13; 463/19

(58) Field of Classification Search ..... 463/30–34, 463/10–11, 13, 16, 25, 29, 42–43
See application file for complete search history.

(56) References Cited

U.S. PATENT DOCUMENTS 4,467,424 A * 8/1984 Hedges et al. ..... 463/26
5,382,025 A * 1/1995 Sklansky et al. ..... 273/292
5,687,968 A * 11/1997 Tarantino ..... 273/139
5,762,552 A * 6/1998 Vuong et al. ..... 463/25
5,770,533 A * 6/1998 Franchi ..... 463/42
5,800,268 A * 9/1998 Molnick ..... 463/40
5,830,067 A * 11/1998 Graves et al. ..... 463/40
5,830,068 A * 11/1998 Brenner et al. ..... 463/42
5,839,731 A * 11/1998 Feola ..... 273/292
5,871,213 A * 2/1999 Chadband et al. ..... 273/292
6,120,376 A * 9/2000 Cherry ..... 463/16
6,299,533 B1 * 10/2001 Parra et al. ..... 463/17
6,450,887 B1 * 9/2002 Mir et al. ..... 463/42
6,508,709 B1 * 1/2003 Karmarkar ..... 463/42

(Continued)

FOREIGN PATENT DOCUMENTS

JP 2005-131298 5/2005
JP 2005-168740 6/2005

OTHER PUBLICATIONS

Lagarto, Four Winds Mah Jong, Jan. 20, 2008, www.4windsmj.com/.*

(Continued)

*Primary Examiner* — Dmitry Suhol
*Assistant Examiner* — Jason Yen
(74) *Attorney, Agent, or Firm* — Jordan and Hamburg LLP

(57) ABSTRACT

A game machine includes a game progress controller, a main image display controller, a supplementary information generator, and a sub-image display controller. The game progress controller accepts operational information entered from a touch panel and from other game machines and successively obtains tile objects representing tiles of individual players. The main image display controller defines arrangement zones for the tile objects representing the tiles of the individual players within a main screen area, displays the tile objects so that patterns of tile objects of a primary player are visually recognizable, and substitutes the tile objects obtained by drawing actions for specified ones of the tile objects. The supplementary information generator generates supplementary information regarding the tile objects that are displayed in a visually recognizable fashion. The sub-image display controller displays the supplementary information in a sub-screen area located adjacent to the main screen area.

10 Claims, 11 Drawing Sheets

U.S. PATENT DOCUMENTS

| | | | | |
|---|---|---|---|---|
| 6,511,068 | B1 * | 1/2003 | Sklansky et al. | 273/237 |
| 6,679,777 | B2 * | 1/2004 | Pfeiffer et al. | 463/42 |
| 6,695,695 | B2 * | 2/2004 | Angel | 463/13 |
| 6,929,264 | B2 * | 8/2005 | Huard et al. | 273/274 |
| 7,516,959 | B2 * | 4/2009 | Huard et al. | 273/274 |
| 2002/0058548 | A1 * | 5/2002 | Stronach | 463/25 |
| 2002/0103028 | A1 * | 8/2002 | Carter et al. | 463/42 |
| 2003/0195043 | A1 * | 10/2003 | Shinners et al. | 463/42 |
| 2003/0220143 | A1 * | 11/2003 | Shteyn et al. | 463/42 |
| 2004/0009812 | A1 * | 1/2004 | Scott et al. | 463/28 |
| 2004/0198483 | A1 * | 10/2004 | Amaitis et al. | 463/16 |
| 2004/0235542 | A1 * | 11/2004 | Stronach et al. | 463/6 |
| 2005/0227757 | A1 * | 10/2005 | Simon | 463/25 |
| 2006/0217167 | A1 * | 9/2006 | Jubinville et al. | 463/13 |
| 2006/0223605 | A1 * | 10/2006 | Pullman | 463/16 |
| 2006/0252520 | A1 * | 11/2006 | Platis | 463/28 |
| 2006/0258438 | A1 * | 11/2006 | Platis | 463/25 |
| 2007/0155488 | A1 | 7/2007 | Kubota et al. | |

OTHER PUBLICATIONS

All Mah Jong, All Mah Jong, Nov. 3, 2006, www.allmj.com.*

Peterb, Solitaire's Not the Only Game in Town, Jul. 5, 2005, www.tleaves.com/weblog/archives/000399.html.*

FunnyMan, Japanese Mahjong, Sep. 15, 2008, jayisgames.com/archives/2008/09/japanese_mahjong.php.*

Mark, Mark's Mahjong Page, Apr. 4, 2006, www.creativegraces.net/mahjong.html.*

Yahoo, Mahjong Rules, May 18, 2006, games.yahoo.com/help/rules/mj&tab=mjglossary.*

Piusranson, Online Mahjong, Feb. 25, 2008, steveranson.wordpress.com/2008/02/25/online-mahjong.*

* cited by examiner

NETWORKED GAME MACHINE, GAME INFORMATION DISPLAY AND GAME PROGRAM FOR MAHJONG GAME

CROSS REFERENCE

This Nonprovisional application claims priority under 35 U.S.C. §119(a) on Patent Application No. 2009-020613 filed in Japan on Jan. 30, 2009, the entire contents of which are hereby incorporated by reference.

FIELD OF THE INVENTION

The present invention relates to a technique for displaying game information on game machines which are configured to permit a plurality of players to play a competitive game, such as a mahjong game, with the aid of communication means.

BACKGROUND OF THE INVENTION

Various types of video-game machines which permit a plurality of players to play against one another have conventionally been proposed or are currently in use. A known example of an arcade game system is configured such that a plurality of video-game machines (hereinafter referred to simply as game machines) of the same model are connected to one another by a network (and a server), such as a local area network (LAN) or the Internet, to enable a plurality of players to play a competitive game in a common game space.

Japanese Unexamined Patent Application Publication Nos. 2005-168740 and 2005-131298 each describe a mahjong game played by four competing players by use of four game machines which are connected to one another by a network. In an actual mahjong game, each player arranges his or her mahjong tiles in an upright position with the marked (pattern) side of each tile facing himself or herself so that his or her opponents can not see the tiles. To simulate such a situation on a game screen of each game machine, tile objects representing a player's own mahjong tiles are presented face up so that the player can visually recognize the types of the tiles whereas tile objects representing his or her opponents' mahjong tiles are presented in a reversed upright position (or face down) so that the opponents can not visually recognize the types of the tiles. As illustrated in FIG. 21 of Japanese Unexamined Patent Application Publication No. 2005-168740 and FIG. 5 of Japanese Unexamined Patent Application Publication No. 2005-131298, tile objects representing mahjong tiles of one player are displayed in a visually recognizable fashion in a lower part of a game playing screen whereas tile objects representing mahjong tiles of opponent players are displayed face down in a visually unrecognizable fashion in upper, left and right parts of the game playing screen. For the sake of explanation in the present Specification, a player who plays against his or her opponent players is hereinafter referred to as a primary player.

Japanese Unexamined Patent Application Publication No. 2005-131298 also describes a display control method which allows a primary player to alter the arrangement of his or her mahjong tile objects by designating a tile object to be moved and specifying a new location of the designated tile object by use of a touch panel. In this display control method, the game machine of the primary player who rearranges the tile objects transmits information on his or her tile rearrangement operation to the other game machines operated by the opponent players so that the opponent players can observe on the respective game screens how the primary player is going to rearrange the tile objects in a true-to-life appearance.

While the individual game machines used for playing a mahjong game present the tile objects of the opponent players uniformly in a visually unrecognizable fashion as described in Japanese Unexamined Patent Application Publication Nos. 2005-168740 and 2005-131298 cited above, this display method, if employed alone, tends to cause the participating players to loose interest in playing the mahjong game because the players feel that the game always played in this way is less eventful and less exciting. In fact, persons participating in a mahjong game conducted by game machines sometimes wish to play the mahjong game according to different mahjong rules. One approach to satisfying this requirement would be to present the game screen of the game machine operated by the primary player and the game screens of the game machines operated by the opponent players in different ways. For example, Japanese Unexamined Patent Application Publication No. 2005-131298 proposes an arrangement in which a display method used for presenting information concerning a tile object designating action made by the primary player on his or her game screen differs from a display method used for presenting information concerning tile object designating actions made by the opponent players on the respective game screens, thereby creating realistic sensations. However, this approach employing a combination of these two different display methods is related simply to how each player designates a tile object to be moved on the game screen of the game machine and is not intended to present information concerning tile objects gained by each player in an easily recognizable fashion.

SUMMARY OF THE INVENTION

It is an object of the present invention to provide a game machine, a game information display method and a game program which allow a player to play a competitive game in a manner capable of creating situational variations and exciting feelings by displaying objects of a specified one of opponent players in a visually recognizable fashion in a main screen area and information regarding objects gained by the player or the specified one of the opponent players in an easily recognizable fashion in a sub-screen area.

According to an important feature of the present invention, a game information display method is used by a game machine provided with a display device which displays an image including a plurality of arranged objects and an operating device which permits a primary player to specify and manipulate a desired one of the objects, the game machine being configured to carry out a competitive game by transmitting and receiving operational information through communications to and from other game machines having respective operating devices operated by a plurality of opponent players, the game machine comprising a game progress controller, a first display controller, a supplementary information generator and a second display controller. The game information display method comprises the steps of causing the game progress controller to advance the competitive game by accepting the operational information entered from the operating device operated by the primary player as well as the operational information entered from the other game machines operated by the opponent players and thereby obtaining successively specified ones of the objects for the individual players, causing the first display controller to define arrangement zones where the objects of the individual players are arranged in a plurality of regions within a main screen area of the display device, display the objects of the individual players in such a manner that types of the objects of the primary player and at least one of the opponent players are visually recognizable, and vary the on-screen appearance of the objects as the respective players gain the objects during the progress of the competitive game, causing the supplementary information generator to generate supplementary information regarding the objects of at least one of the primary player and the opponent player whose objects are displayed such that the types thereof are visually recognizable from gained object information regarding the gained objects acquired by the game progress controller, and causing the second display controller to display the supplementary information in a sub-screen area located adjacent to the main screen area.

These and other objects, features and advantages of the invention will become more apparent upon a reading of the following detailed description in conjunction with the accompanying drawings.

DETAILED DESCRIPTION OF THE PREFERRED EMBODIMENT OF THE INVENTION

Figure 1:
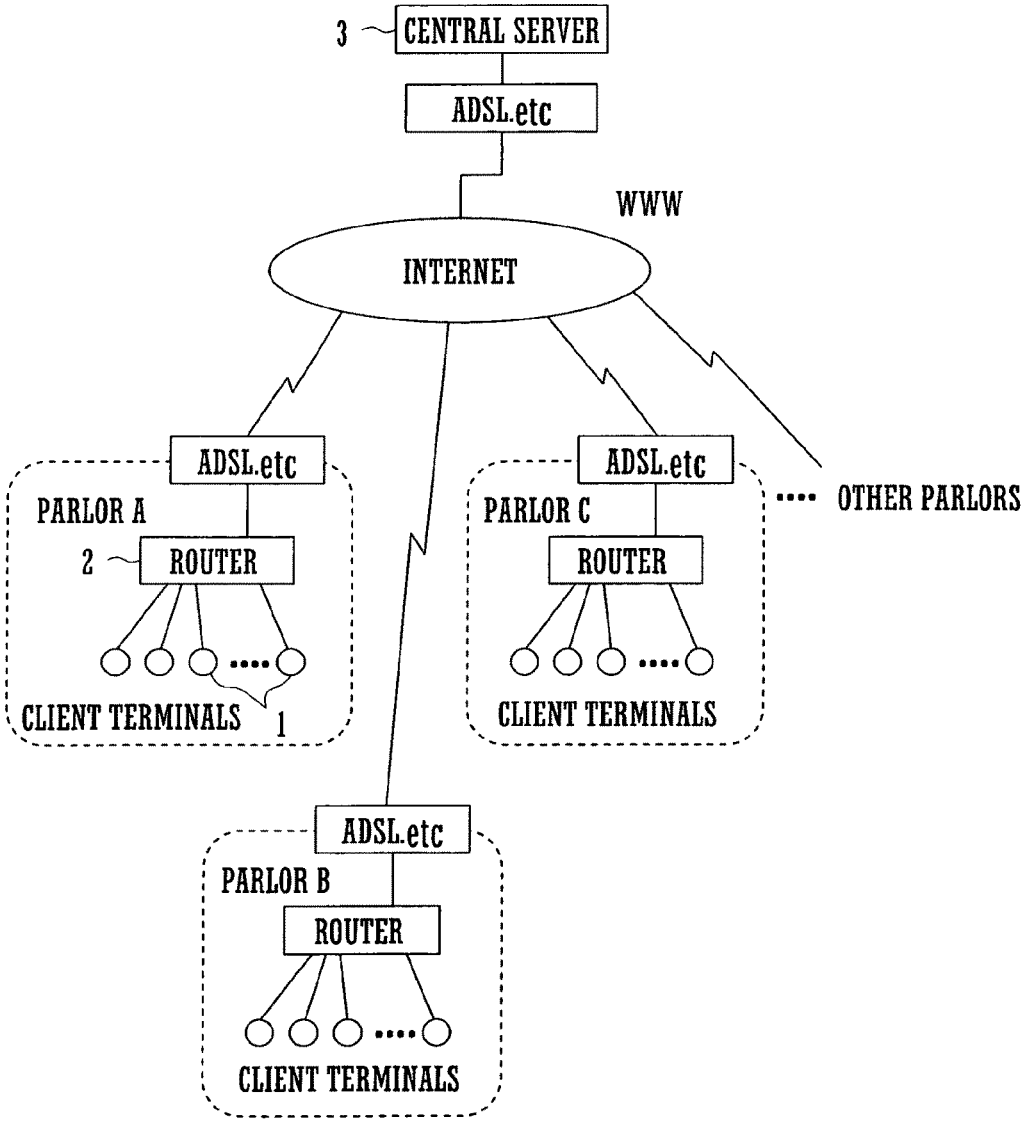
FIG. 1 is a general configuration diagram of a competitive game system employing game machines according to an embodiment of the present invention.

FIG. 1 is a configuration diagram of a competitive game system employing game machines according to an embodiment of the present invention. The competitive game system comprises a plurality of (in this case, eight) client terminal apparatuses (game machines) 1 to which identification information is individually assigned, routers 2 each of which is a communication device communicatably connected to the individual client terminal apparatuses 1 provided in one arcade game parlor to enable communication therebetween and to client terminal apparatuses provided in other arcade game parlors to enable communication therewith over a network (i.e., the Internet), and a central server apparatus 3 communicatably connected to the individual client terminal apparatuses 1 through the routers 2 for managing information concerning player authentication, player selection and game histories.

Each of the client terminal apparatuses 1 allows a player to proceed with a game by performing prescribed operations while watching a game screen presented on a monitor. The identification information held by each of the client terminal apparatuses 1 includes identification information assigned to the router 2 to which the client terminal apparatuses 1 are connected (or identification information assigned to an arcade game parlor where the client terminal apparatuses 1 are located) and identification information (i.e., a terminal number) assigned to each of the client terminal apparatuses 1 located in the arcade game parlor. If the identification information assigned to arcade game parlor A is "A" and the identification information assigned to a particular client terminal apparatus 1 in arcade game parlor A is "4", then the identification information given to that client terminal apparatus 1 is "A4", for example.

Each of the routers 2 is communicatably connected to the client terminal apparatuses 1 provided in one arcade game parlor and to the central server apparatus 3 to permit transmission and reception of data between the client terminal apparatuses 1 and the central server apparatus 3.

The central server apparatus 3 which is communicatably connected to each of the routers 2 stores player information in association with player identification codes (player IDs) used for designating the individual players and serves to select players (opponents) who will play a competitive game in a common game space with a primary player at any one of the client terminal apparatuses 1 by transmitting and receiving data to and from the relevant client terminal apparatuses 1.

Figure 2:
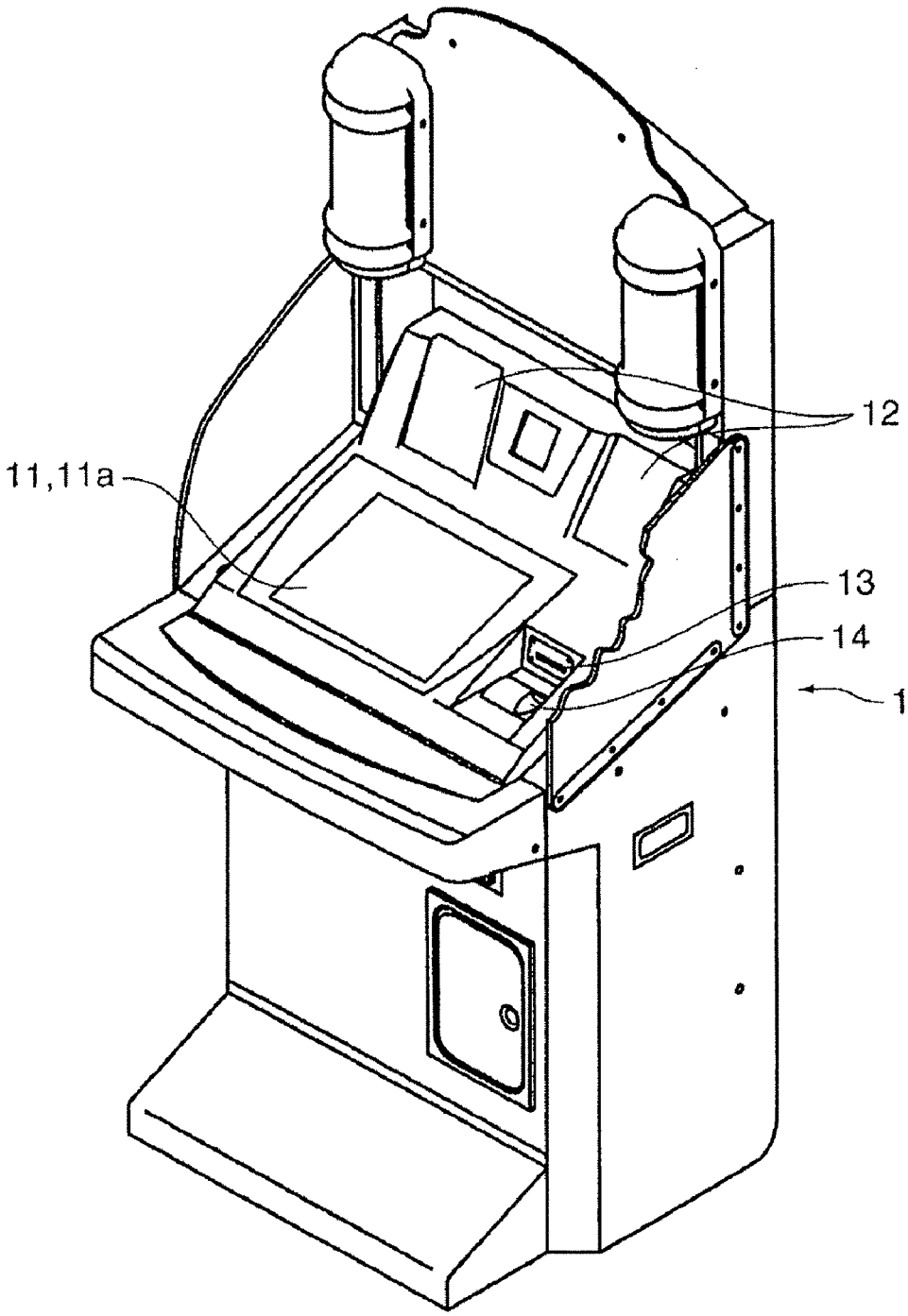
FIG. 2 is a perspective diagram illustrating the external appearance of a client terminal apparatus according to the embodiment.

FIG. 2 is a perspective diagram illustrating the external appearance of one of the client terminal apparatuses 1 of the embodiment. In the following discussion of the present embodiment, it is assumed that the competitive game played by use of the client terminal apparatus 1 is a simulated mahjong game. The competitive game, or the mahjong game, is a game which is normally played by four players by operating the respective client terminal apparatuses 1. When conducting such a competitive game, each client terminal apparatus 1 exchanges data concerning operations performed by the individual players with the other client terminal apparatuses 1 through a later-described network communication section 18 and the router 2.

The client terminal apparatus 1 is provided with a monitor (display device) 11 which presents a game screen, a touch panel (operating device) 11*a* having a plurality of touchpad keys (or buttons) showing options presented on the game screen that prompt the player to select a desired operation whereby the client terminal apparatus 1 can determine which button has been pressed by the player on the basis of the location of each depression on the touch panel 11*a* corresponding to one of addresses of the individual buttons, a speaker 12 which produces audible messages, tones or music, a card reader 13 which reads information, such as a user ID, stored in a user card and a coin input section 14 which accepts coins inserted by the player. The monitor 11 includes a liquid-crystal display (LCD) or a plasma display, for example, for displaying an image. A display screen of the monitor 11 has a main screen area 500 defined in a principal screen portion for presenting a gaming image and a smaller-sized sub-screen area 600 defined in a prescribed screen portion, at the right side of the display screen as will be discussed later with reference to FIGS. 7, 9 and 10. The aforementioned user card is a magnetic card, an integrated circuit (IC) card or the like that stores personal information containing a card ID, for instance.

At an appropriate location within the client terminal apparatus 1, there is provided a control section 16 (refer to FIG. 3) including a microcomputer or the like which receives sensing signals from various section and outputs control signals to each section.

Figure 3:
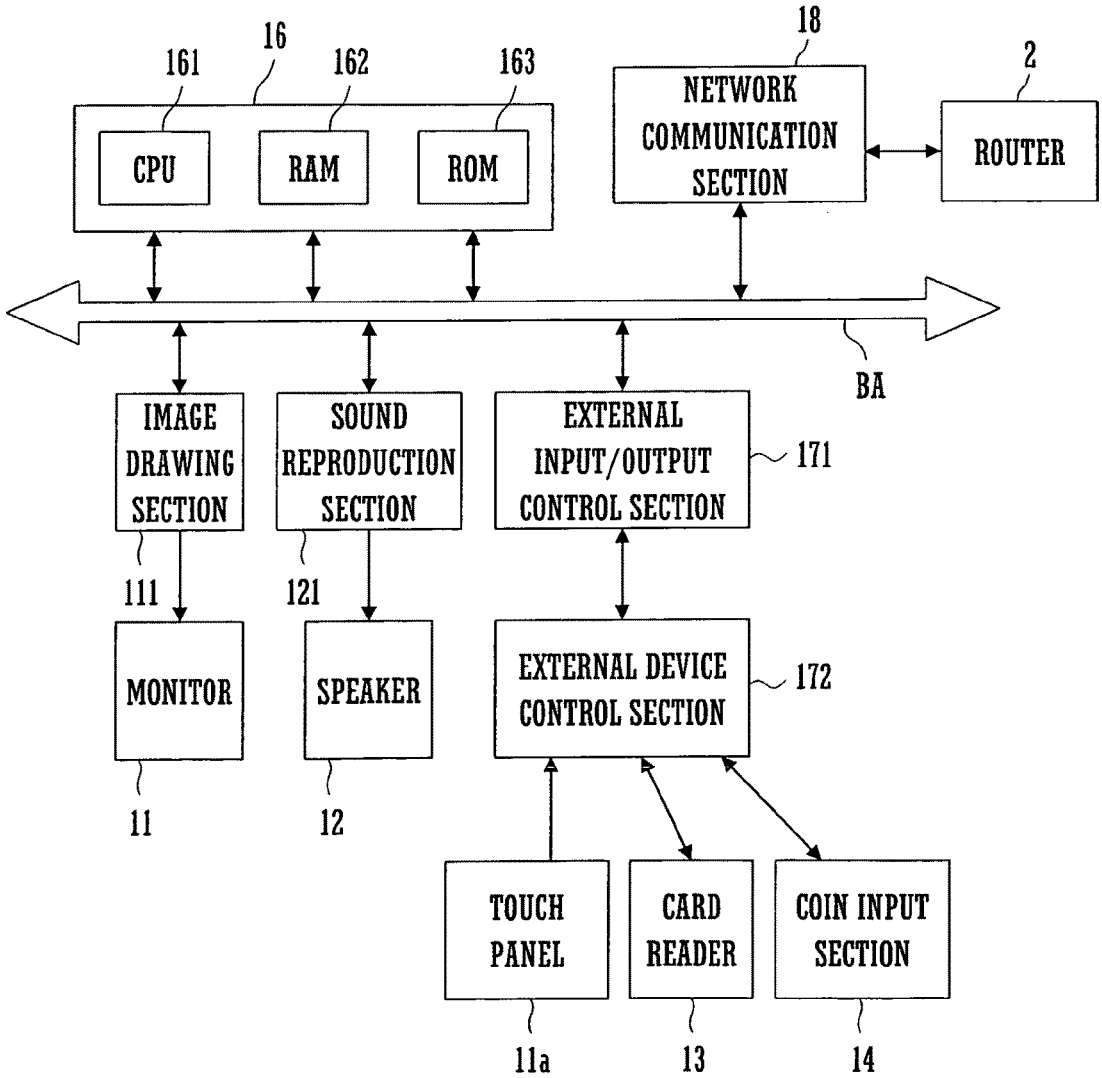
FIG. 3 is a hardware configuration diagram showing an embodiment of the client terminal apparatus.

FIG. 3 is a hardware configuration diagram of the client terminal apparatus 1 of the embodiment. The control section 16 controls the operation of the client terminal apparatus 1 as a whole and includes a CPU 161 serving as an information processor for carrying out operations related to the progress of each game, an image display operation and various other information processing operations, a random access memory (RAM) 162 for temporarily storing in-process information, for instance, and a read-only memory (ROM) 163 on which is stored beforehand prescribed image information and a game program, for instance.

Referring to FIG. 3, an external input/output control section 171 converts the sensing signals input from a sensing section including such devices as the card reader 13, the touch panel 11*a* and the coin input section 14 into digital signals which can be processed by the control section 16. The external input/output control section 171 also converts command information into control signals and outputs the control signals to the respective devices of the sensing section. The external input/output control section 171 is configured to perform such signal processing and input/output operations in a time-division fashion, for example. An external device control section 172 performs operations for outputting the control signals to the individual devices of the sensing section and inputting the sensing signals from the individual devices of the sensing section during time slots respectively allocated in a time division scheme.

An image drawing processing section 111 including a video RAM and the like serves to draw and present a prescribed image on the monitor 11 according to an image display command fed from the control section 16. A sound reproduction section 121 serves to create audible messages and/or background music, for instance, according to a command fed from the control section 16.

The ROM 163 stores such image elements as mahjong tile objects, background images and various kinds of screen image elements. The image elements like the mahjong tile objects are each structured with a required number of polygons so that these image elements can be drawn three-dimensionally. According to an image drawing command fed from the CPU 161, the image drawing processing section 111 performs such mathematical operations as calculation for converting positions in a three-dimensional space into positions in a simulated three-dimensional space and calculation for defining a light source location, as well as operations for writing image data used for drawing the image elements in the video RAM, such as an operation for writing (pasting) texture data in an area of the video RAM defined by a polygon, for example, on the basis of the results of the calculations mentioned above. The ROM 163 also stores the later-described image information concerning image elements that are displayed in the sub-screen area 600.

Now, a relationship between the operation of the CPU 161 and the operation of the image drawing processing section 111 is described. The CPU 161 reads out image, sound and control program data as well as game program data prepared according to a specified mahjong rule from the ROM 163 under the control of an operating system (OS) recorded in the ROM 163 which may be of the incorporated or removable type and inserted into an image display processing section for outputting the image information and displaying the same on the monitor 11. Part or all of the image, sound and control program data thus read is held in the RAM 162. Thereafter, the CPU 161 performs processing operations according to a control program held in the RAM 162, various kinds of data (i.e., the image data including data on polygons representing objects displayed on-screen, a texture and object data as well as the sound data) and the sensing signals fed from the sensing section. The ROM 163 also stores mahjong-related information containing image data for individual tile objects and information on plural kinds of "yaku" (a mahjong term meaning a specific combination of tiles that increases the value of a player's hand), for example.

Among various kinds of data stored in the ROM 163, data stored on a removable storage medium may be made readable by such a drive as a hard disk drive, an optical disc drive, a flexible disk drive, a silicon disk drive, a cassette medium reading device, for example. In this case, a suitable storage medium is a hard disk, an optical disc, a flexible disk, a compact disc (CD), a digital versatile disc (DVD) or a semiconductor memory, for example.

The aforementioned network communication section 18 of the client terminal apparatus 1 performs transmission and reception of operational information occurring during execution of a mahjong game concerning operations performed by the primary player playing at the client terminal apparatus 1 to and from the other client terminal apparatuses 1 operated the competing players (opponents) through the respective routers 2, and through the network. The network communication section 18 also performs transmission and reception of information concerning personal authentication (player authentication) during a process of accepting a new player and game scoring information available at a point of completion of each game to and from the central server apparatus 3 through the relevant router 2.

Figure 4:
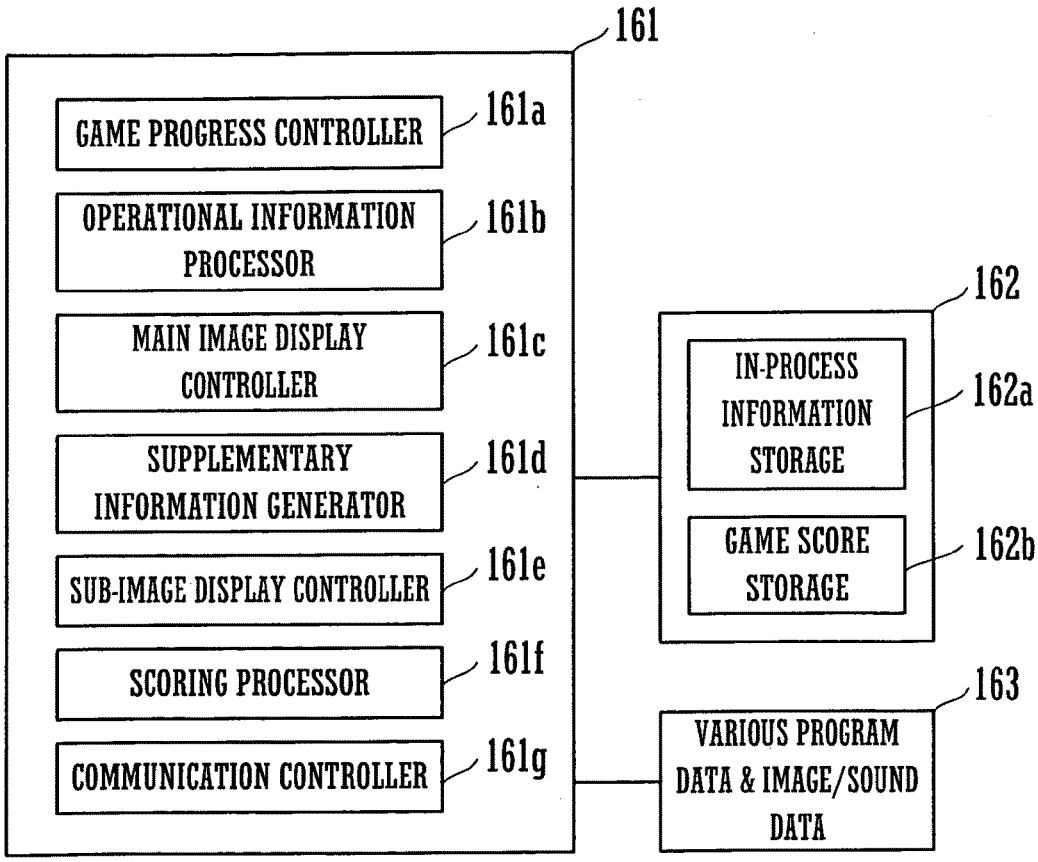
FIG. 4 is a functional configuration diagram of a control section of the client terminal apparatus.

FIG. 4 is a functional configuration diagram of the control section 16 of the client terminal apparatus 1. By executing the game program and the control program held in the RAM 162, the CPU 161 serves as a plurality of functional blocks including a game progress controller 161*a* which controls the progress of a mahjong game from a starting point to an ending point thereof, an operational information processor 161*b* which receives operational information entered from the touch panel 11*a* operated by the primary player and operational information entered by the opponent players through the network communication section 18 and, then, reflects these pieces of operational information to the progress of the mahjong game, a main image display controller 161*c* which controls on-screen presentation of the gaming image in the main screen area 500 of the monitor 11, a supplementary information generator 161*d* which generates supplementary information related to mahjong tiles held by one player who is specified in a later-described fashion from gained tile information acquired by the operational information processor 161*b*, a sub-image display controller 161*e* which controls on-screen presentation of the supplementary information in the sub-screen area 600 located adjacent to the main screen area 500, a scoring processor 161*f* which generates a final result of the game (i.e., the value of each player's point sticks) and determines relative positions of the individual players in the ranking thereof at the end of the game, and a communication controller 161*g* which controls exchanges of various kinds of information. The scoring processor 161*f* keeps watch on the value of each player's point sticks that varies from the beginning to the end of the game which may include a specific number of rounds played on a simulated mahjong board. At the ending point of the game, the scoring processor 161*f* determines the value of the point sticks held by each player in an imaginary fashion and gives the ranking of the individual players expressed in the order of scores finally gained by the players. In this configuration, the game progress controller 161*a* and the operational information processor 161*b* together constitute a game progress controller.

The RAM 162 of the control section 16 is configured to include an in-process information storage block 162*a* for storing constantly updated in-process game information which contains the operational information produced by the individual players playing the mahjong game on the same mahjong board (game space), the in-process game information being continually input directly by the primary player and through the network communication section 18 by the opponent players, and a game score storage block 162*b* for storing the relative positions of the individual players in the ranking thereof (together with the values of the individual players' point sticks where necessary) representing the game result determined by the scoring processor 161*f* at the ending point of the game individually for all the players. If the game has normally been finished, the in-process game information stored in the in-process information storage block 162*a* is erased before another game is started.

Figure 5:
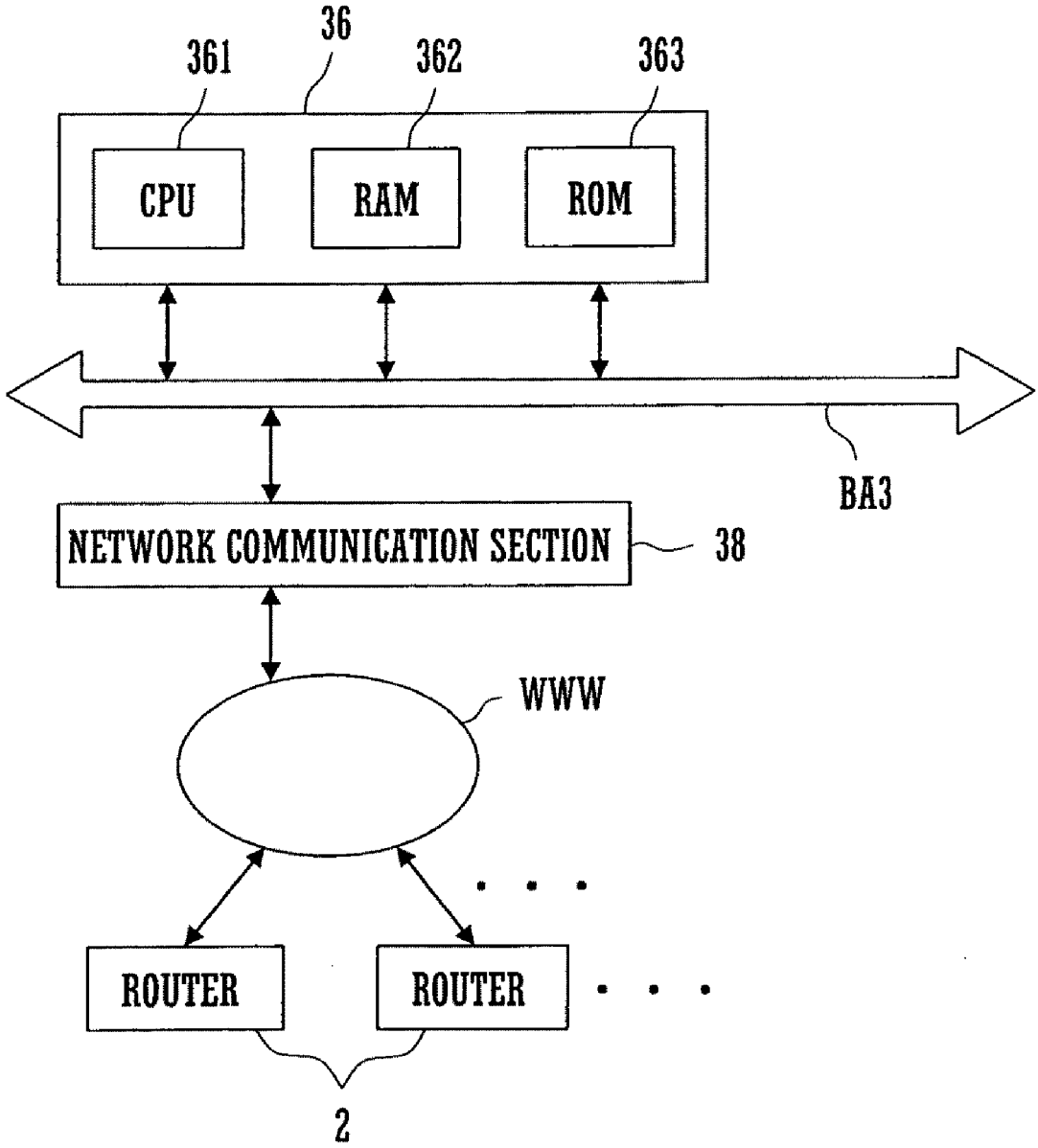
FIG. 5 is a hardware configuration diagram of a central server apparatus according to the embodiment.

FIG. 5 is a hardware configuration diagram of the central server apparatus 3 according to the present embodiment. The central server apparatus 3 is provided with a control section 36 for controlling overall operation of the central server apparatus 3, the control section 36 including a CPU 361 serving as an information processor, a RAM 362 for temporarily storing in-process information, for instance, and a ROM 363 in which prescribed image information, personal information of each player and player information of each player concerning games, for instance, are stored in advance.

Among various kinds of data stored in the ROM 363, data stored on a removable storage medium may be made readable by such a drive as a hard disk drive, an optical disc drive, a flexible disk drive, a silicon disk drive, a cassette medium reading device, for example. In this case, a suitable storage medium is a hard disk, an optical disc, a flexible disk, a CD, a DVD or a semiconductor memory, for example.

A network communication section 38 also provided in the central server apparatus 3 performs transmission and reception of various kinds of data to and from any specified one of the client terminal apparatuses 1 according to terminal identification information through a network like the Worldwide Web (abbreviated WWW) and one of the routers 2.

A game management program stored on the ROM 363 is loaded into the RAM 362 and the CPU 361 executes the game management program held in the RAM 362 to perform functions successively activated by running the program.

Figure 6:
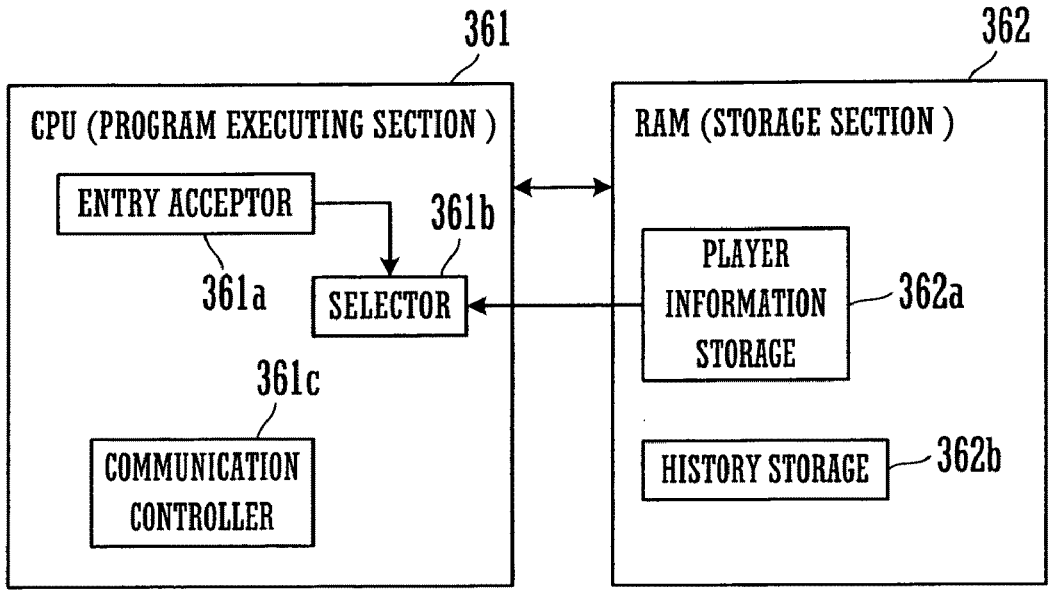
FIG. 6 is a functional configuration diagram of a control section of the central server apparatus.

FIG. 6 is a functional configuration diagram of the control section 36 of the central server apparatus 3. By executing the game management program held in the RAM 362, the CPU 361 of the control section 36 serves as a plurality of functional blocks including an entry acceptor 361*a* which accepts participation of a player in a game at the beginning thereof at each of the client terminal apparatuses 1, a selector 361*b* which selects opponent players by allocating the player accepted by the entry acceptor 361*a* to a simulated mahjong board according to a prescribed rule, and a communication controller 361*c* which controls exchanges of information (containing information regarding the competing players who have been selected and game scoring information regarding the individual players, for example) with the individual client terminal apparatuses 1.

The RAM 362 of the control section 36 is configured to include a player information storage block 362*a* for storing such personal information as user ID data and a history storage block 362*b* for storing a constantly updated history of the game scoring information (game result) of the individual players.

The entry acceptor 361*a* receives such personal information as user ID data of a player who wishes to participate in a game when the personal information is transmitted from one of the client terminal apparatuses 1. The entry acceptor 361*a* admits the player to the game on the basis of the player information maintained in the player information storage block 362*a*.

The selector 361*b* selects (or combines) four players who will play in a common game space (simulated mahjong board) from among all players accepted by the entry acceptor 361*a* according to a prescribed rule. Specifically, the selector 361*b* selects the four participating players in the order of entries or depending on whether any candidate players are similarly ranked in game playing skill when judged on the basis of playing histories of the individual players, for instance.

Discussed now is how a mahjong game is normally conducted from the beginning to the point of completion of the game in the above-described competitive game system of the invention. When the client terminal apparatus 1 detects that a player has inserted his or her user card into the card reader 13 and a specific amount of coin(s) into the coin input section 14, the game progress controller 161*a* reads the user ID and other pieces of information from the user card by executing a player acceptance function and transmits the user ID and the associated information to the central server apparatus 3.

Upon receiving the user ID of the newly participating player and the associated information, the entry acceptor 361*a* of the central server apparatus 3 collates the received user ID and information held in the player information storage block 362*a* and accepts the player if appropriate. Individual players thus accepted are allocated to a simulated mahjong board so that the players can play in the same game space (mahjong board). When four accepted players have been allocated to the simulated mahjong board, the central server apparatus 3 transmits competing player information containing names of the participating players (contestants) who will play a game on the same mahjong board to the respective client terminal apparatuses 1. Subsequently, upon receiving a game starting command from the central server apparatus 3, the client terminal apparatuses 1 perform a processing step for starting a game under the control of the respective game progress controllers 161*a*. Then, seating positions (sides) of the individual players are determined, a first dealer is designated, and a round of the game is commenced.

Following the commencement of the round, the game progress controllers 161*a* of the client terminal apparatuses 1 deal tiles to the individual players, who are then allowed to sequentially perform game playing operations in a counterclockwise direction, starting from the player acting as the first dealer. One round of the game is finished when one of the players wins a hand. When a specified number of rounds have finished, game results available at that point in time are transmitted from the individual client terminal apparatuses 1 to the central server apparatus 3 and, as a result, data contents held in the history storage blocks 362*b* of the respective players are updated. Each client terminal apparatus 1 presents on the monitor 11 thereof a guiding screen showing, for example, a CONTINUE button and an END button which allow the player to determine whether or not to continue playing the game. The client terminal apparatus 1 enables the player to proceed to a next game if the player touches the CONTINUE button and inserts the specified amount of coin(s) into the coin input section 14, whereas the client terminal apparatus 1 terminates the game and ejects the user card if the player touches the END button.

EXAMPLE 1

Example 1 of the present invention is now described with reference to FIGS. 7 and 8.

Figure 7:
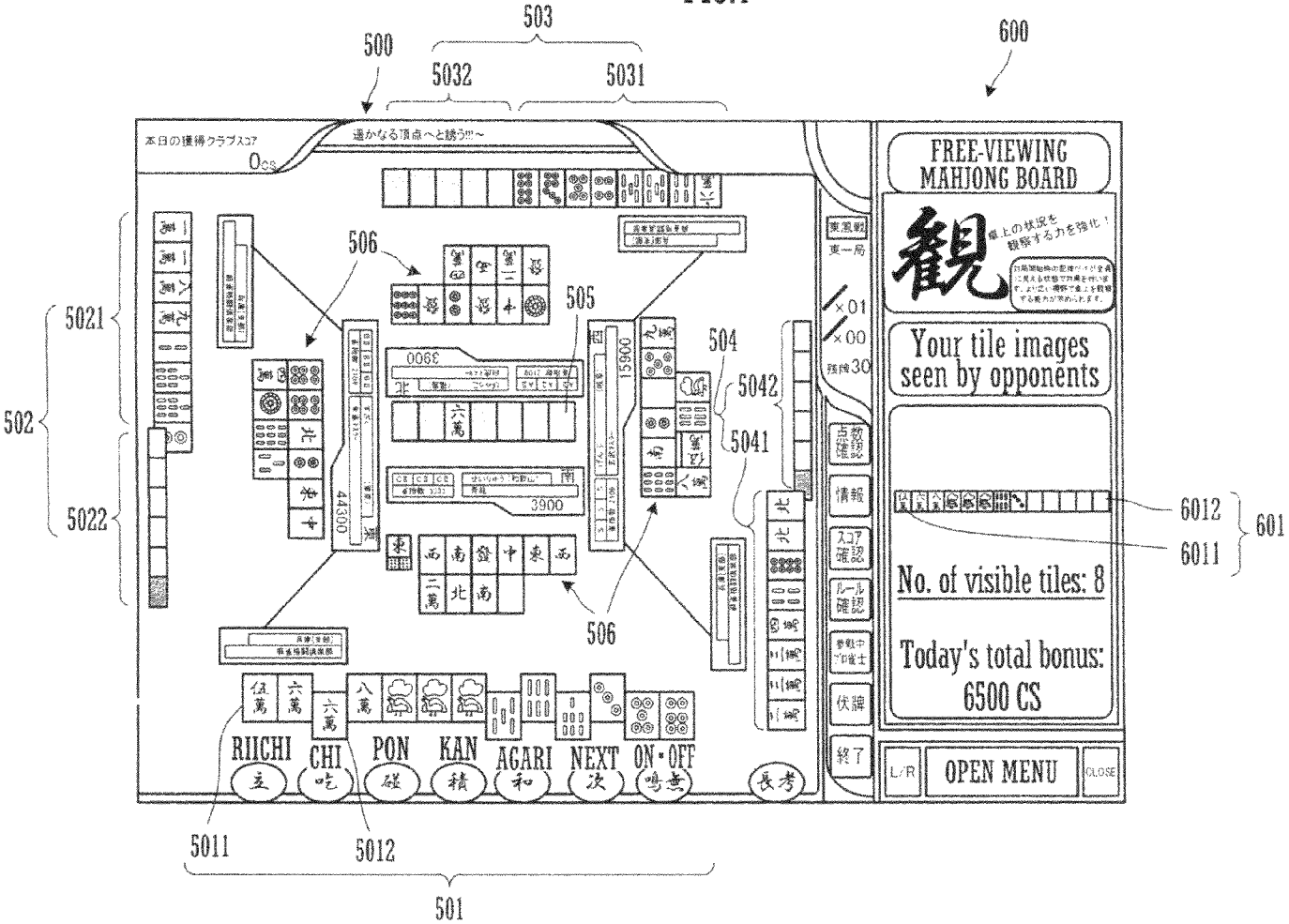
FIG. 7 is a diagram illustrating an exemplary game playing screen according to Example 1.

FIG. 7 is a diagram illustrating an exemplary game playing screen according to Example 1. As depicted in FIG. 7, the monitor 11 has the main screen area 500 and the sub-screen area 600 to present an in-process gaming image and supplementary information, respectively.

The main screen area 500 shows a wall of tile objects 501 representing the primary player's own tiles arranged in a lower part of the gaming image in such a manner that types (patterns) of the tile objects 501 can be seen as well as walls of tile objects 502, 503, 504 representing tiles possessed by the opponent players arranged in left, upper and right parts of the gaming image, respectively. The opponent players' tile objects 502, 503, 504 are displayed as if part of the tile objects 502, 503, 504 are placed such that the patterns marked thereon can be seen while the rest of the tile objects 502, 503, 504 are placed face down such that the patterns marked thereon can not be seen. Generally, a state in which a tile pattern is visible corresponds to a situation where a tile object is placed face up so that a pattern side of the tile object is directed toward an imaginary camera representing the player's point of view, whereas a state in which a tile pattern is invisible corresponds to a situation where a tile object is placed in an upright position with the pattern side thereof directed against the imaginary camera.

In Example 1 discussed here, all of the tile objects 501-504 dealt to the individual players are displayed face up so that the tile patterns are visually recognizable at the time of dealing. As a result of drawing actions repeatedly performed while the game is in progress, tile objects 5021, 5031, 5041 remaining from the time of dealing among the initially dealt tile objects 502-504 are kept in an original (face-up) position thereof, whereas tile objects 5022, 5032, 5042 substituted (drawn) in place of specific ones of the initially dealt tile objects 502-504 are displayed as if in an upright position so that tile patterns on these tile objects 5022, 5032, 5042 are visually unrecognizable.

While all of the tile objects 501 of the primary player are displayed in a visually recognizable fashion, the monitor 11 presents the primary player's tile objects 501 in two different ways for differentiation thereof, that is, in a face-up position (first presentation mode) and in an upright position (second presentation mode). Referring to FIG. 7, tile objects 5011 displayed in the face-up position (first presentation mode) represent initially dealt tiles, and tile objects 5012 displayed in the upright position (second presentation mode) represent tiles substituted as a result of drawing actions. It is to be noted that, in mahjong terminology, an opponent player seated to the left of the primary player is referred to as "kamicha" (left-hand player) and an opponent player seated to the right of the primary player is referred to as "shimocha" (right-hand player). The participating players successively perform drawing actions in a left-to-right direction (counterclockwise direction as illustrated in FIG. 7).

Also displayed in the main screen area 500 are a pile of tile objects 505 located generally at the middle of the on-screen gaming image containing "dora" indicator tiles, and piles of discarded tile objects 506 representing discarded tiles located around the piled tile objects 505. In addition, the main screen area 500 shows at the bottom a plurality of buttons including a RIICHI button that is pressed when declaring "riichi", a CHII button that is pressed when making a "chii" call, a PON button that is pressed when making a "pon" call, a KAN button that is pressed when making a "kan" call, an AGARI button that is pressed when making an "agari" (winning a hand) call, a NEXT button that is pressed when proceeding to a next player at a right-hand seating position, and a NAKI button that is pressed when selecting whether or not to make a call for a tile discarded by any of the opponent players.

The sub-screen area 600 of the monitor 11 shows tile objects 601 which represent the tile objects 501 obtained by the primary player up to a present point in time in a manner differing from a manner in which the tile objects 501 are displayed in the main screen area 500. In the example of FIG. 7, the tile objects 601 displayed in the sub-screen area 600 show how the tile objects 501 of the primary player are displayed in the main screen areas 500 of the client terminal apparatuses 1 operated by the opponent players. The tile objects 601 displayed in the sub-screen area 600 include a group of tile objects 6011 corresponding to a group of the tile objects 5011 which are presented in the face-up position (first presentation mode) in the main screen area 500 and a group of tile objects 6012 corresponding to a group of the tile objects 5012 which are presented in the upright position (second presentation mode) in the main screen area 500. The tile objects 6011 and the tile objects 6012 thus distinguished from one another in on-screen appearance are displayed as being arranged in line in the sub-screen area 600.

As depicted in FIG. 7, patterns on the tile objects 6011 displayed face up are visible, while patterns on the tile objects 6012 displayed face down are invisible. The sub-screen area 600 also shows a number of the tile objects 5011 (tile objects 6011), a statement like "No. of visible tiles: 8", for example, at an appropriate location relative to the tile objects 601, immediately below the tile objects 601 in the illustrated example.

Reasons why the tile objects 6011, 6012 are displayed in the sub-screen area 600 are as follows. Referring to FIG. 7, the tile objects 502 possessed by the opponent player seated to the left of the primary player are distinguishably divided into the initially dealt tile objects 5021 whose tile patterns are visible and the subsequently drawn tile objects 5022 whose tile patterns are invisible as mentioned earlier. The tile objects of the opponent players are displayed in this fashion because one would loose interest in playing the game almost entirely if the tile patterns on the tile objects of all the opponent players are visually recognizable. Under such circumstances, the tile objects are displayed in such a manner that each player can only see the tile patterns on at least the tile objects initially dealt to the opponent players but can not visually recognize the tile patterns on the tile objects gained by the opponent players as a result of subsequent drawing actions. This tile object display scheme is employed to maintain a specific level of interest in playing the game. It is to be noted that the expression "draw" (or "drawing") refers to an action of a player picking up a mahjong tile from the piled tile objects 505 and such drawing actions are successively performed by the individual players in a specific sequence.

On the monitor 11 of the client terminal apparatus 1 operated by the opponent player at the left-hand seating position, the tile objects possessed by the primary player (i.e., the tile objects 501 shown in FIG. 7) are displayed at the right side of the main screen area 500, or at the right-hand seating position. Therefore, although the monitor 11 of the primary player shows the tile patterns on all of the primary player's tile objects 501 in a visually recognizable fashion (FIG. 7), the monitor 11 of the opponent player at the left-hand seating position shows the tile patterns on the same tile objects 501 in such a manner that the patterns on the initially dealt tile objects 5011 are visible and the patterns on the subsequently gained tile objects 5012 are invisible depending on events that have occurred after the time of dealing as mentioned in the foregoing discussion. The primary player can rearrange the tile objects 501 into a desired order on his or her own monitor 11. The above-described tile object display scheme is advantageous in that the opponent players can not easily estimate how the primary player is proceeding with the game from the arrangement of the tile objects 5011 displayed in the face-up position and the tile objects 5012 displayed in the upright position. Thus, the sub-screen area 600 serves to supplementarily illustrate how the tile objects 501 of the primary player are displayed on the monitor 11 of each opponent player in an easy-to-recognize fashion. Additionally, the sub-screen area 600 supplementarily shows the tile objects 6011 and the tile objects 6012 in two distinguishable groups, generally reproducing on-screen images of the tile objects 6011, 6012 actually displayed on the monitor 11 of each opponent player.

Figure 8:
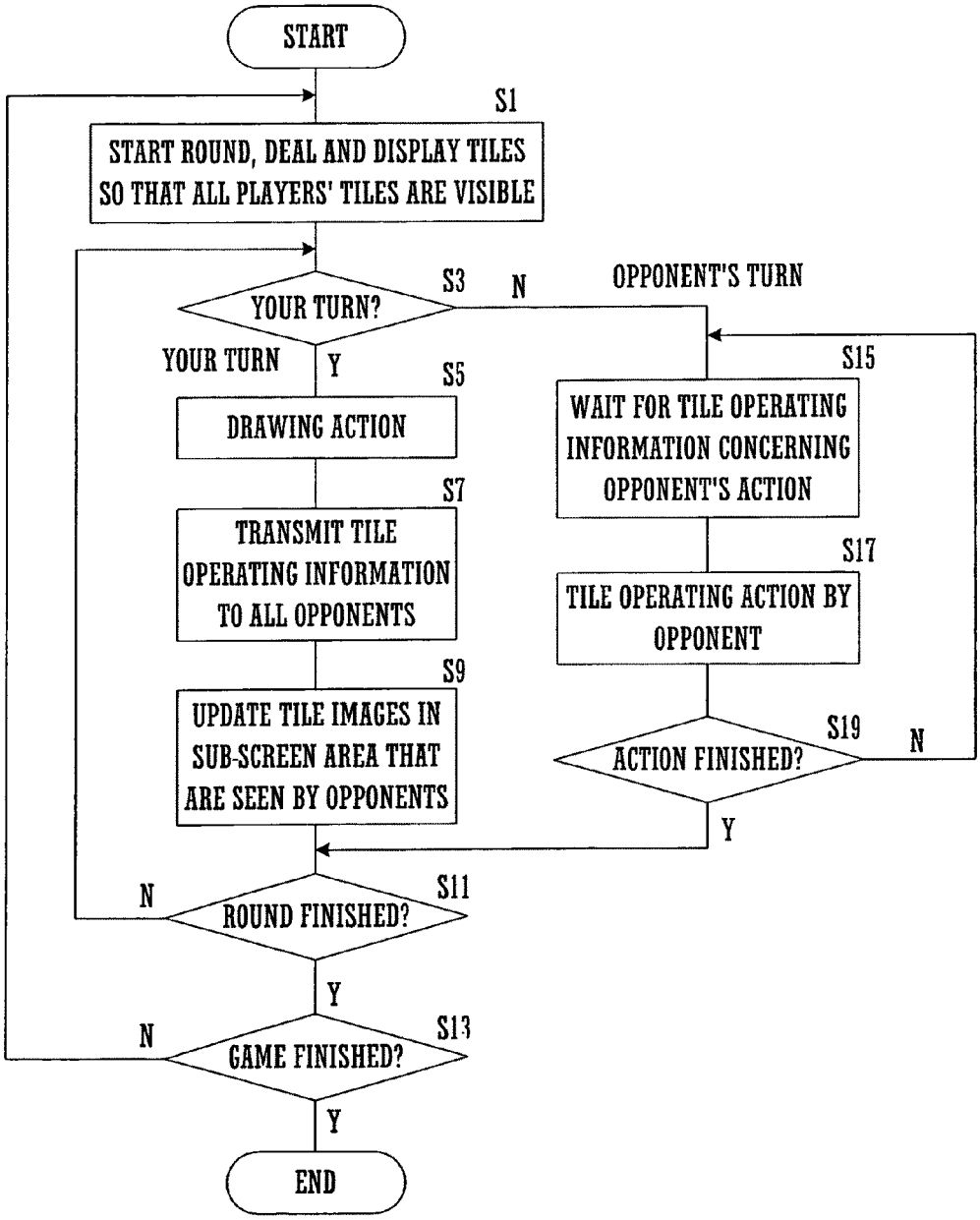
FIG. 8 is a flowchart showing a sequence of operations executed by a central processing unit (CPU) of the control section of the client terminal apparatus using a game program and a display program of Example 1 for displaying game playing actions and tile objects.

FIG. 8 is a flowchart showing a sequence of operations executed by the CPU 161 using a game program and a display program of Example 1 for displaying game playing actions and tile objects. When a round of a game is started, the CPU 161 performs a tile dealing operation (step S1). The tile dealing operation executed in Example 1 is a process in which the CPU 161 randomly distributes a prescribed number of tiles (normally 13 tiles) chosen from a specific number of tiles to each of the participating players and displays (arranges) tile objects representing the tiles allocated to each player in a single row (wall) in a predefined arrangement zone in such a manner that tile patterns of the tile objects are visually recognizable.

Next, the CPU 161 judges whether it is currently the turn of the primary player (or of the client terminal apparatus 1 operated by the primary player) to perform a drawing action (step S3). If it is currently the turn of the primary player, the CPU 161 accepts an instruction entered by the primary player through the touch panel 11*a* indicating whether to draw or discard a tile and executes the instruction thus accepted (step S5). An operation performed in this step is as follows, for example: if the primary player specifies one of the piled tile objects 505, the specified tile object 505 is treated as a discarded tile object 506; and if the primary player specifies one of the tile objects 501 representing tiles possessed by himself or herself, the specified tile object 501 is treated as a discarded tile object 506 and an assumption is made that the primary player has drawn one of the piled tile objects 505. Then, the CPU 161 causes the client terminal apparatus 1 of the primary player to transmit resultant tile operating information to the client terminal apparatuses 1 of all the opponent players through the network communication section 18 (step S7) and causes the supplementary information generator 161*d* to generate and update the supplementary information displayed in the sub-screen area 600 (step S9).

Subsequently, the CPU 161 judges whether or not the current round has finished depending on whether a prescribed game playing time has elapsed or one of the players has won (step S11). If the round is judged to have not finished yet, the CPU 161 returns to step S3 to allow the next player (i.e. the right-hand player) to perform a drawing action. If the round is judged to have finished, on the other hand, the CPU 161 then judges whether a specified number of rounds constituting one game have finished (step S13). If the game has not been completed yet, the CPU 161 returns to step S1 to begin another round. If the game is judged to have been completed, on the other hand, the CPU 161 performs a game ending operation. Specifically, the CPU 161 causes the client terminal apparatus 1 to display the game result (scoring information) on the monitor 11 and transmit the same to the central server apparatus 3.

If it is not currently the primary player's turn to perform a drawing action as judged in step S3, the CPU 161 waits for tile operating information concerning any opponent player's action that is received through the network communication section 18 (step S15), and when the tile operating information is received, the CPU 161 performs a display operation for displaying tile objects representing the opponent player's tiles in a manner relevant to a tile operating action made by the opponent player (step S17). For example, if the action made by the opponent player is a draw-and-discard action ("tsumokiri"), the CPU 161 produces no change in on-screen images of the tile objects representing the opponent player's tiles but simply presents the effect of the draw-and-discard action in a simulated fashion. On the other hand, if the action made by the opponent player is a drawing action, object type information concerning the type of the tile object just drawn associated with information used for determining whether or not to display the tile object is input and, then, the CPU 161 updates on-screen images of the opponent player's mahjong tile characters displayed in the corresponding arrangement zone by using these pieces of information.

Then, the CPU 161 judges whether the opponent player has finished his or her tile operating action (step S19). If the tile operating action has not been finished yet, the CPU 161 returns to step S15 and waits for the tile operating information. Taking into consideration the fact that it is not so easy to select a tile in certain circumstances, a specific waiting time is predefined to allow a delay from a point of the occurrence of a tile drawing action to an ending point of the tile operating action. The client terminal apparatus 1 may be so configured as to forcibly execute the draw-and-discard action in a case where the tile operating action is not finished within the predefined waiting time.

EXAMPLE 2

Example 2 of the present invention is now described with reference to FIGS. 9 to 11.

Figure 9:
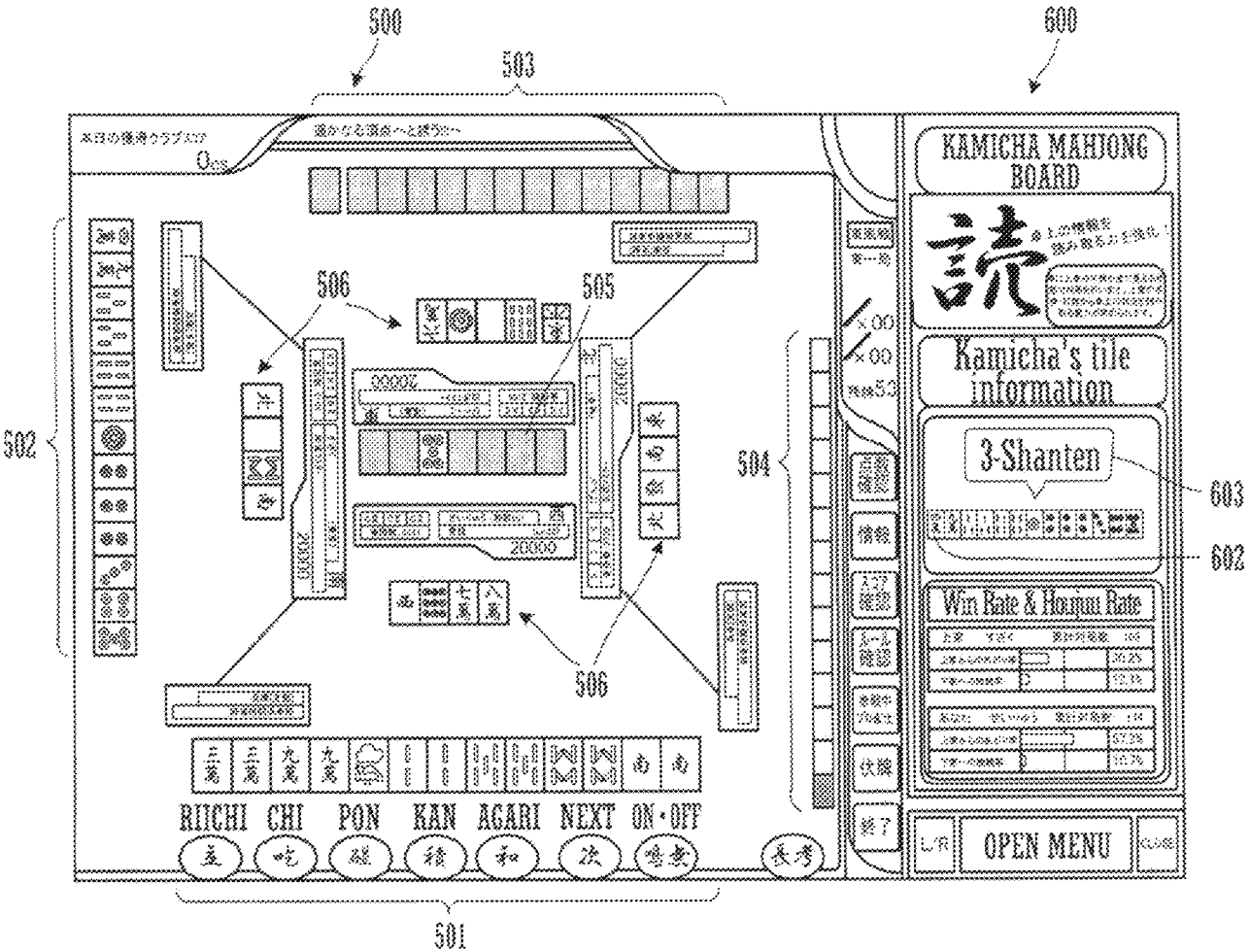
FIG. 9 is a diagram illustrating an exemplary game playing screen according to Example 2.

FIG. 9 is a diagram illustrating an exemplary game playing screen according to Example 2. Referring to FIG. 9, the monitor 11 has the main screen area 500 and the sub-screen area 600 to present an in-process gaming image and supplementary information, respectively, in the same fashion as in FIG. 7.

The following discussion focuses chiefly on those points which differ from what is illustrated in FIG. 7. The main screen area 500 shows a wall of tile objects 501 representing the primary player's own tiles arranged in a lower part of the gaming image in such a manner that types (patterns) of the tile objects 501 can be seen as well as walls of tile objects 502, 503, 504 representing tiles possessed by the opponent players arranged in left, upper and right parts of the gaming image, respectively. Among opponent players' tile objects 502, 503, 504, the tile objects 502 of the left-hand player located in the left part of the gaming image are displayed in such a manner that the patterns marked on these tile objects 502 are visually recognizable, while the other opponent players' tile objects 503, 504 located in the upper and right parts of the gaming image are all displayed as if placed face down so that their tile patterns can not be seen as in the earlier-mentioned arrangement of the prior art.

In Example 2 discussed here, all of the tile objects 501, 502 are displayed such that the patterns marked thereon are visually recognizable all the way from the time of dealing to a round ending point. This means that the patterns of the individual tile objects 501, 502 of the primary player and the left-hand player are uniformly displayed on-screen regardless of whether the player draws and discards a tile or draws and keeps a tile by performing a drawing action unlike the case of Example 1. The tile objects 501 of the primary player are also displayed in the same fashion regardless of whether the primary player draws and discards a tile or draws and keeps a tile by performing a drawing action.

The sub-screen area 600 of the monitor 11 shows tile objects 602 which represent the tile objects 502 obtained by the opponent player seated to the left of the primary player up to a present point in time in a manner differing from a manner in which the tile objects 502 are displayed in the main screen area 500. Specifically, while the tile objects 502 displayed in the main screen area 500 are arranged vertically in line, the tile objects 602 displayed in the sub-screen area 600 are arranged horizontally in line on the monitor 11 as depicted in FIG. 9.

The sub-screen area 600 also shows forecast information indicating how many tiles are needed to reach "Tenpai" (a hand that needs only one tile to win) at an appropriate location relative to the tile objects 602 representing the tile objects 502 currently possessed by the left-hand player, immediately above the tile objects 602 in the illustrated example. The forecast information is displayed in the form of text information 603 which reads "3-Shanten" (indicating 3 tiles away from "Tenpai") in the example of FIG. 9. The supplementary information generator 161*d* is configured to calculate the number of tiles needed to reach a winning hand on the basis of a difference between the arrangement of the tile objects 502 displayed in the main screen area 500 and the tile arrangement of a hand closest to a win that can be reached from the current arrangement of the tile objects 502.

In Example 2, the tile objects 502 representing the tiles possessed by the opponent player seated to the left of the primary player are displayed such that the patterns marked thereon can be seen. This tile object display scheme is employed based on the assumption that one would loose interest in playing the game if the primary player's tile objects are displayed such that the patterns marked thereon can be seen by all the opponent players and, in particular, the primary player can obtain a tile discarded by the left-hand player by touching the CHII button.

Reasons why the tile objects 602 are displayed horizontally in line in the sub-screen area 600 are as follows. Since the tile objects 502 possessed by the opponent player seated to the left of the primary player are arranged vertically in line in the main screen area 500 of the monitor 11, the primary player observes these tile objects 502 from an angular direction differing from an ordinary viewing direction, or from an unfamiliar viewing direction and, therefore, it is not easy for the primary player to recognize details of the tile objects 502 gained by the left-hand player at a glance or in a very short time. Thus, the tile objects 602 showing horizontally arranged images of the tile objects 502 are generated by the supplementary information generator 161*d* and displayed in the sub-screen area 600 as part of the supplementary information to enable the primary player to quickly recognize how the tile objects 502 of the left-hand player are arranged. The supplementary information on the sub-screen area 600 depicting the arrangement of the left-hand player's tile objects 602 associated with the text information 603 indicating the number of tiles makes it easier to analyze and predict how many tiles and which types of tiles are needed by the left-hand player to win a hand.

It is to be pointed out that the tile objects 502 of the left-hand player may be displayed in the same way as in Example 1. In this case, it is preferable that the tile objects 501 of the primary player be also displayed in the same way as in Example 1.

Figure 10:
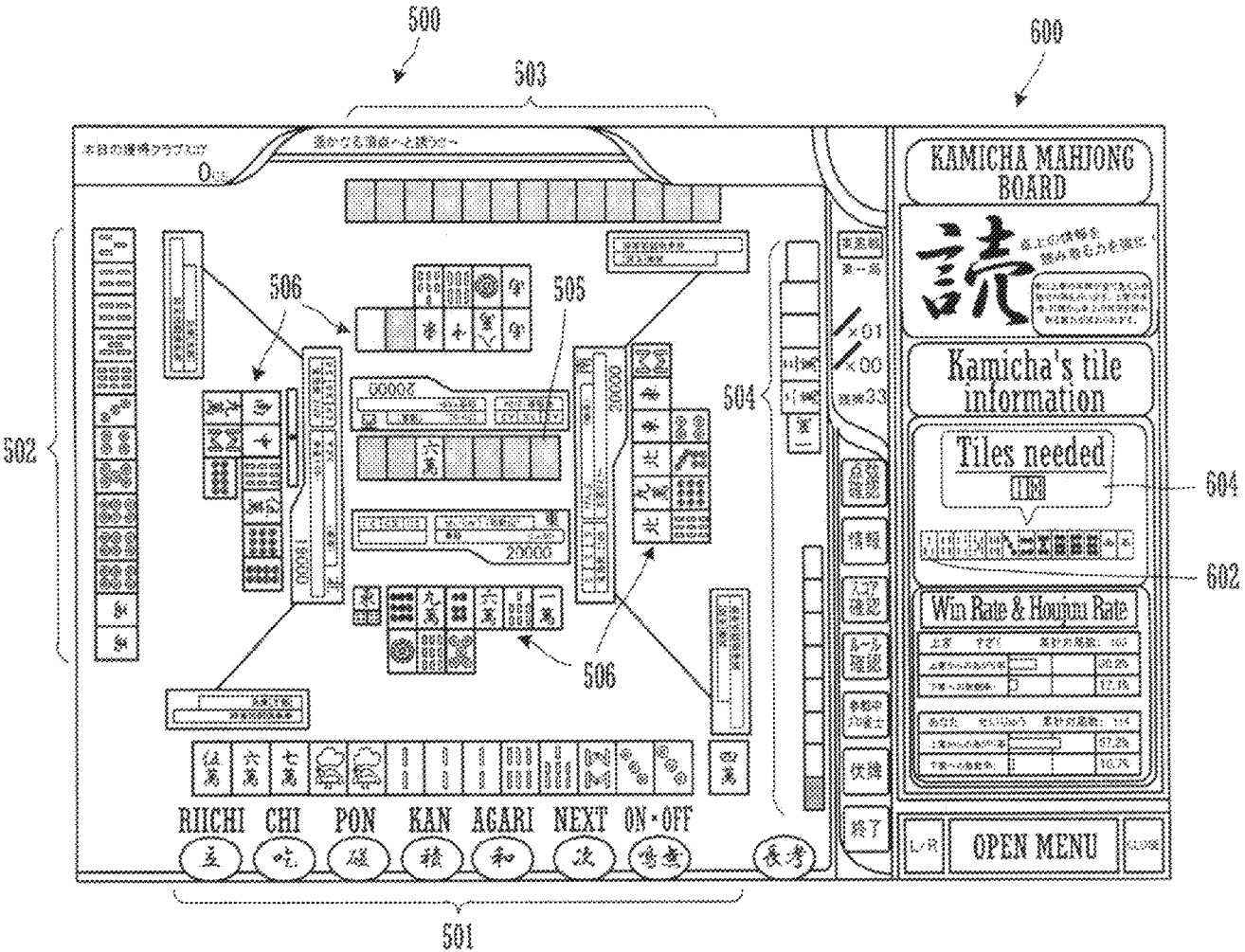
FIG. 10 is a diagram illustrating a game playing screen according to a varied form of Example 2.

FIG. 10 is a diagram illustrating a game playing screen of which sub-screen area 600 shows the supplementary information according to a varied form of Example 2. Referring to FIG. 10, the tile objects 502 representing tiles possessed by the opponent player seated to the left of the primary player are displayed as the tile objects 602 in the sub-screen area 600 as being arranged horizontally in line. The sub-screen area 600 also shows tile objects 604 representing one or more tiles needed to finish a round ("machipai") at an appropriate location relative to the tile objects 602, immediately above the tile objects 602 in the illustrated example of FIG. 10.

A precondition that allows the supplementary information generator 161*d* to display the tile objects 604 representing "machipai" tiles may be such that the tile objects 502 are in a "Tenpai" state (requiring only one more tile to win) or such that the tile objects 502 are in a "Tenpai" state and the RIICHI button has been touched. In the example of FIG. 10, the sub-screen area 600 shows two types of tile objects 604 representing "machipai" tiles because these two types of tiles are needed to win a round. The supplementary information generator 161*d* is configured to keep watch on whether the difference between the arrangement of the tile objects 502 displayed in the main screen area 500 and the tile arrangement of a hand closest to a win that can be reached from the current arrangement of the tile objects 502 has become just one tile and to display the tile objects 604 in the sub-screen area 600 at a point in time when this difference has become one tile.

Figure 11:
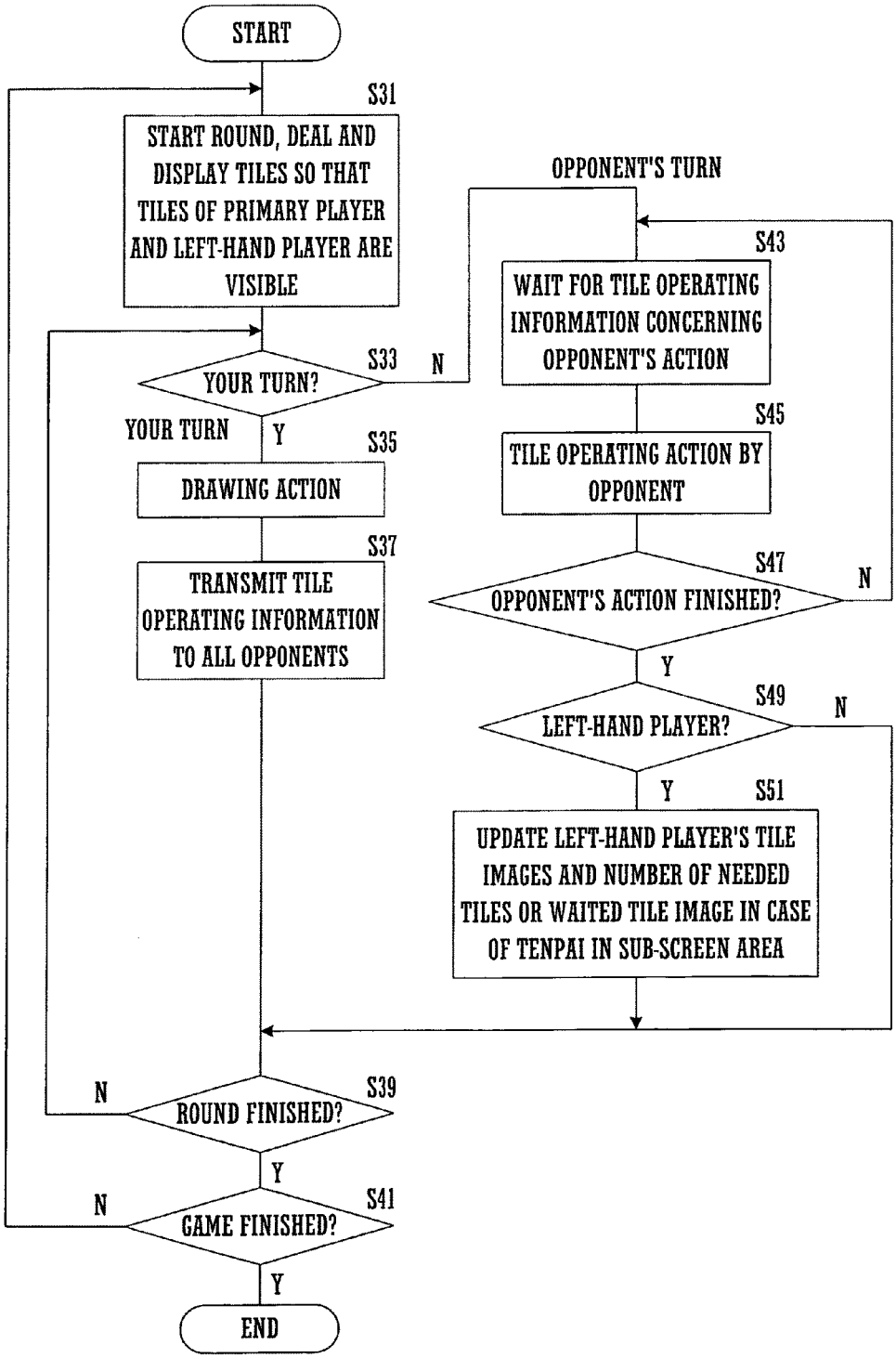
FIG. 11 is a flowchart showing a sequence of operations executed by the CPU of the control section of the client terminal apparatus using a game program and a display program of Example 2 for displaying game playing actions and tile objects.

FIG. 11 is a flowchart showing a sequence of operations executed by the CPU 161 using a game program and a display program of Example 2 for displaying game playing actions and tile objects. When a round of a game is started, the CPU 161 performs a tile dealing operation (step S31). The tile dealing operation executed in Example 2 is a process in which the CPU 161 randomly distributes a prescribed number of tiles (normally 13 tiles) chosen from a specific number of tiles to each of the participating players and displays (arranges) tile objects representing the tiles allocated to each player in a single row (wall) in a predefined arrangement zone in such a manner that the patterns marked on the tile objects 501, 502 possessed respectively by the primary player and the left-hand player are visually recognizable.

Next, the CPU 161 judges whether it is currently the turn of the primary player (or of the client terminal apparatus 1 operated by the primary player) to perform a drawing action (step S33). If it is currently the turn of the primary player, the CPU 161 accepts an instruction entered by the primary player through the touch panel 11*a* indicating whether to draw or discard a tile and executes the instruction thus accepted (step S35). An operation performed in this step is as follows, for example: if the primary player specifies one of the piled tile objects 505, the specified tile object 505 is treated as a discarded tile object 506; and if the primary player specifies one of the tile objects 501 representing tiles possessed by himself or herself, the specified tile object 501 is treated as a discarded tile object 506 and an assumption is made that the primary player has drawn one of the piled tile objects 505. Then, the CPU 161 causes the client terminal apparatus 1 of the primary player to transmit resultant tile operating information to the client terminal apparatuses 1 of all the opponent players through the network communication section 18 (step S37).

Subsequently, the CPU 161 judges whether or not the current round has finished depending on whether a prescribed game playing time has elapsed or one of the players has won (step S39). If the round is judged to have not finished yet, the CPU 161 returns to step S33 to allow the next player (i.e. the right-hand player) to perform a drawing action. If the round is judged to have finished, on the other hand, the CPU 161 then judges whether a specified number of rounds constituting one game have finished (step S41). If the game has not been completed yet, the CPU 161 returns to step S31 to begin another round. If the game is judged to have been completed, on the other hand, the CPU 161 performs a game ending operation. Specifically, the CPU 161 causes the client terminal apparatus 1 to display the game result (scoring information) on the monitor 11 and transmit the same to the central server apparatus 3.

If it is not currently the primary player's turn to perform a drawing action as judged in step S33, the CPU 161 waits for tile operating information concerning any opponent player's action that is received through the network communication section 18 (step S43), and when the tile operating information is received, the CPU 161 performs a display operation for displaying tile objects representing the opponent player's tiles in a manner relevant to a tile operating action made by the opponent player (step S45). For example, if the action made by the opponent player is a draw-and-discard action ("tsumokiri"), the CPU 161 produces no change in on-screen images of the tile objects representing the opponent player's tiles but simply presents the effect of the draw-and-discard action in a simulated fashion. On the other hand, if the action made by the opponent player is a drawing action, information associated with object type information concerning the type of the tile object just drawn is input, so that relevant pieces of information are stored as tile objects representing the opponent player's mahjong tile characters.

Then, the CPU 161 judges whether the opponent player has finished his or her tile operating action (step S47). If the tile operating action has not been finished yet, the CPU 161 returns to step S43 and waits for the tile operating information. Subsequently, the CPU 161 judges whether the tile operating information is concerned with the tile operating action of the left-hand player (step S49). If the tile operating information received is not concerned with the left-hand player's tile operating action, the CPU 161 proceeds to step S39. If the tile operating information is judged to have originated from the left-hand player's tile operating action, the CPU 161 performs a display operation for updating the supplementary information presented in the sub-screen area 600 (step S51), the supplementary information including the horizontally arranged tile objects 602 representing the left-hand player's tile objects 502 associated with the text information 603 indicating the number of tiles needed to reach a "Tenpai" state (requiring only one more tile to win) (see FIG. 9) or the tile objects 604 representing "machipai" tiles which are displayed only in the "Tenpai" state (see FIG. 10). After updating the supplementary information in the sub-screen area 600 in this fashion, the CPU 161 proceeds to step S39.

While the invention has thus far been described with reference to the preferred embodiment and specific Examples thereof, the aforementioned arrangements of the embodiment are simply illustrative and may be modified in various ways. Cited under (1) to (5) below are some examples of such modifications of the embodiment.

(1) While all of the tile objects 501-504 are initially displayed in such a manner that the patterns marked thereon are visually recognizable in Example 1 discussed above, this arrangement may be modified such that visually recognizable tile objects are combinations of tile objects of a specific number of players or other appropriate combinations of tile objects which are determined on condition that the visually recognizable tile objects include the tile objects 501. Also, while the tile objects 501, 502 are displayed in such a manner that the types (patterns) thereof are visually recognizable in Example 2 discussed above, this arrangement may be modified such that visually recognizable tile objects are combinations of tile objects of a specific number of players or other appropriate combinations of tile objects which are determined on condition that the visually recognizable tile objects include the tile objects 501.

(2) While the tile objects initially dealt are kept in such a manner that the patterns marked thereon are visually recognizable and the tile objects subsequently gained are displayed in such a manner that the patterns marked thereon are visually unrecognizable to permit a distinction therebetween in the foregoing embodiment, the invention is not limited to this method of tile object differentiation. For example, different types of tile objects, such as character tiles and design tiles, may be differentiated in terms of their visibility.

(3) The aforementioned arrangement of Example 2 may be modified such that the ROM 163 of the control section 16 of each client terminal apparatus 1 stores a display program including a display rule for differently displaying the tile objects 602 of the opponent player seated to the left of the primary player in the sub-screen area 600. Specifically, the display rule may be such that the tile objects initially dealt to the left-hand player and the tile objects subsequently gained thereby are displayed in mutually distinguishable ways, for example. This display rule, if implemented, makes it unnecessary to add the information for determining whether or not to display each tile object drawn by the left-hand player to the information transmitted from the client terminal apparatus 1 operated by the left-hand player.

(4) According to the present invention, the supplementary information which is information regarding the tile objects possessed by the primary player and at least one of the opponent players may be presented in various other ways than those illustrated in FIGS. 7, 9 and 10 for Examples 1 and 2.

(5) The foregoing embodiment of the invention and specific Examples thereof are applicable not only to the mahjong game but also to various other competitive thinking games, such as card games like trump games, Go games and chess games.

In summary, a game machine according to one feature of the invention is provided with a display device which displays an image including a plurality of arranged objects and an operating device which permits a primary player to specify and manipulate a desired one of the objects, the game machine being configured to carry out a competitive game by transmitting and receiving operational information through communications to and from other game machines having respective operating devices operated by a plurality of opponent players. This game machine comprises a game progress controller for advancing the competitive game by accepting the operational information entered from the operating device operated by the primary player as well as the operational information entered from the other game machines operated by the opponent players and thereby obtaining successively specified ones of the objects for the individual players, a first display controller for defining arrangement zones where the objects of the individual players are arranged in a plurality of regions within a main screen area of the display device, displaying the objects of the individual players in such a manner that types of the objects of the primary player and at least one of the opponent players are visually recognizable, and varying the on-screen appearance of the objects as the respective players gain the objects during the progress of the competitive game, a supplementary information generator for generating supplementary information regarding the objects of at least one of the primary player and the opponent player whose objects are displayed such that the types thereof are visually recognizable from gained object information regarding the gained objects acquired by the game progress controller, and a second display controller for displaying the supplementary information in a sub-screen area located adjacent to the main screen area.

According to another feature of the invention, a game information display method is used by a game machine provided with a display device which displays an image including a plurality of arranged objects and an operating device which permits a primary player to specify and manipulate a desired one of the objects, the game machine being configured to carry out a competitive game by transmitting and receiving operational information through communications to and from other game machines having respective operating devices operated by a plurality of opponent players, the game machine comprising a game progress controller, a first display controller, a supplementary information generator and a second display controller. This game information display method comprises the steps of causing the game progress controller to advance the competitive game by accepting the operational information entered from the operating device operated by the primary player as well as the operational information entered from the other game machines operated by the opponent players and thereby obtaining successively specified ones of the objects for the individual players, causing the first display controller to define arrangement zones where the objects of the individual players are arranged in a plurality of regions within a main screen area of the display device, display the objects of the individual players in such a manner that types of the objects of the primary player and at least one of the opponent players are visually recognizable, and vary the on-screen appearance of the objects as the respective players gain the objects during the progress of the competitive game, causing the supplementary information generator to generate supplementary information regarding the objects of at least one of the primary player and the opponent player whose objects are displayed such that the types thereof are visually recognizable from gained object information regarding the gained objects acquired by the game progress controller, and causing the second display controller to display the supplementary information in a sub-screen area located adjacent to the main screen area.

According to still another feature of the invention, a game program is used by a game machine provided with a display device which displays an image including a plurality of arranged objects and an operating device which permits a primary player to specify and manipulate a desired one of the objects, the game program being configured to cause the game machine to carry out a competitive game by transmitting and receiving operational information through communications to and from other game machines having respective operating devices operated by a plurality of opponent players under the control of a computer. This game program controls the computer to function as a game progress controller for advancing the competitive game by accepting the operational information entered from the operating device operated by the primary player as well as the operational information entered from the other game machines operated by the opponent players and thereby obtaining successively specified ones of the objects for the individual players, a first display controller for defining arrangement zones where the objects of the individual players are arranged in a plurality of regions within a main screen area of the display device, displaying the objects of the individual players in such a manner that types of the objects of the primary player and at least one of the opponent players are visually recognizable, and varying the on-screen appearance of the objects as the respective players gain the objects during the progress of the competitive game, a supplementary information generator for generating supplementary information regarding the objects of at least one of the primary player and the opponent player whose objects are displayed such that the types thereof are visually recognizable from gained object information regarding the gained objects acquired by the game progress controller, and a second display controller for displaying the supplementary information in a sub-screen area located adjacent to the main screen area.

The aforementioned game machine, game information display method and game program of the present invention enable the primary player to play a competitive game with a plurality of opponent players by displaying a gaming image including a plurality of arranged objects on the display device and transmitting and receiving operational information regarding each player's operation on his or her operating device for specifying a desired object. As the game progress controller accepts the operational information entered from the primary player's operating device as well as the operational information entered from the other game machines operated by the opponent players and thereby obtains successively specified ones of the objects for the individual players, the game machine carries out the game (e.g., a mahjong game). The first display controller defines the arrangement zones where the objects of the individual players are arranged in the plurality of regions within the main screen area of the display device, displays the objects of the individual players in such a manner that the types of the objects of the primary player and at least one of the opponent players are visually recognizable, and varies the on-screen appearance of the objects as the respective players gain the objects during the progress of the competitive game. The supplementary information generator generates the supplementary information regarding the objects of at least one of the primary player and the opponent player whose objects are displayed such that the types thereof are visually recognizable from the gained object information regarding the gained objects acquired by the game progress controller, and the second display controller displays the supplementary information thus generated in the sub-screen area located adjacent to the main screen area.

The game machine, game information display method and game program thus configured display the objects of a particular player other than the primary player in a visually recognizable fashion in the main screen area and the gained object information regarding the objects gained by the primary player or the particular opponent player in an easy-to-recognize fashion in the sub-screen area. This enables the players to enjoy a competitive game that offers situational variations, exciting feelings and playing interest. In particular, if applied to a mahjong game, the game machine, game information display method and game program of the invention display tile objects of a particular player other than the primary player in a visually recognizable fashion in the main screen area and the gained object information regarding tile objects gained by the primary player or the particular opponent player in an easy-to-recognize fashion in the sub-screen area, thereby creating additional situational variations, exciting feelings and interest in playing the mahjong game.

In one aspect of the invention, the first display controller is preferably so configured as to define the arrangement zone for the objects of the primary player in a lower part of the main screen area, define the arrangement zones for the objects of the opponent players in upper, left and right parts of the main screen area in accordance with a playing order of the individual opponent players relative to the primary player, and display the objects of the opponent players in the upper, left and right arrangement zones thus defined in such a manner that the objects are arranged widthwise.

According to this configuration, the objects of the primary player are displayed in the arrangement zone defined in the lower part of the main screen area and the objects of the opponent players are displayed in the arrangement zones defined in the upper, left and right parts of the main screen area in accordance with the playing order of the individual opponent players relative to the primary player so that these objects are arranged widthwise in the respective arrangement zones. Therefore, the objects of four players (in the case of a mahjong game etc) are effectively arranged along four sides of the main screen area (mahjong board etc).

In another aspect of the invention, the first display controller is preferably so configured as to display the objects of all of the opponent players in such a manner that the types of part of these objects are visually recognizable.

According to this configuration, the objects of all of the opponent players are displayed such that the types of part of these objects are visually recognizable. This enables the primary player to read the intent of the opponent players to a certain extent, thereby making the mahjong game etc more or less easier to play and creating additional situational variations, exciting feelings and interest in playing the game. Part of the opponent players' objects whose types are visually recognizable may be determined according to contents of operations performed on the objects or the types of the objects.

Preferably, the game machine further comprises a communication device for receiving the operational information regarding operations entered through the operating devices of the other game machines, wherein the first display controller displays those objects which have been gained and substituted for specific ones of the objects of any of the opponent players during the progress of the competitive game in such a manner that the types of the gained objects are visually unrecognizable.

If applied to a mahjong game, for example, this configuration makes it impossible for the primary player to visually recognize the types of tile objects representing tiles gained by a particular opponent player and substituted for his or her tile objects as a result of drawing actions. Therefore, it is difficult for the primary player to read the opponent player's intended "yaku" or intent, making it possible to play a mahjong game that is almost as interesting as an ordinary mahjong game in terms of game playing difficulties.

In another aspect of the invention, the first display controller is preferably so configured as to display the objects obtained by the primary player at the beginning of the competitive game in a first presentation mode and the objects subsequently gained by the primary player during the progress of the competitive game in a second presentation mode.

If applied to a mahjong game, for example, this configuration employing the first and second presentation modes enables the primary player to imagine how the objects (tile objects) representing his or her own tiles are displayed on the display device of the other game machine operated by each opponent player even when the primary player rearranges the tiles in an order corresponding to his or her intended "yaku". This makes it possible to play a mahjong game in a manner similar to what is expected in a mahjong game played by using an ordinary mahjong game machine in terms of game playing interest.

In another aspect of the invention, the game machine is preferably so configured that the supplementary information generator generates the supplementary information including information concerning the first and second presentation modes with respect to the primary player, the second display controller presents the objects displayed in the first presentation mode in the main screen area in such a manner that the types of the objects are visually recognizable and the objects displayed in the second presentation mode in the main screen area in such a manner that the types of the objects are visually unrecognizable on the basis of the supplementary information, and the communication device transmits the supplementary information to the other game machines.

If applied to a mahjong game, for example, this configuration displays the objects of the primary player representing his or her own tiles in such a manner that the primary player can verify how these objects (tile objects) are displayed on the display device of the other game machine operated by each opponent player as part of the supplementary information. This enables the primary player to play the game while reading a hidden part of each opponent player's mind, thereby making it possible to play a mahjong game with much enhanced exciting feelings and playing interest compared to an ordinary mahjong game.

In another aspect of the invention, the second display controller is preferably so configured as to display the objects whose types are visually recognizable and the objects whose types are visually unrecognizable in two mutually distinguishable groups.

If applied to a mahjong game, for example, this configuration displays the objects of the primary player representing his or her own tiles simply in two separate groups on the display device of the other game machine operated by each opponent player. Consequently, compared to a case where these objects (tile objects) are arranged in such a manner that the opponent players can easily read the primary player's intended "yaku", it is possible to make the primary player's intent more difficult to read even if part of the primary player's tile objects are recognizably presented to the opponent players.

In another aspect of the invention, the supplementary information preferably includes the number of the objects whose types are visually recognizable.

If applied to a mahjong game, for example, this arrangement serves to display after a draw-and-discard action the number of objects (tiles) left from the time of dealing, thereby enabling the primary player to instantly recognize a situation created by his or her own drawing action without carefully watching the sub-screen area.

In another aspect of the invention, the first display controller is preferably so configured as to display the objects in such a manner the types of the objects of only one of the opponent players who plays one turn before the primary player in a prescribed playing order are visually recognizable.

If applied to a mahjong game, for example, this configuration enables the primary player to recognize an object (tile) discarded by the left-hand player against which the primary player can make a "chii" call, thereby offering the primary player an opportunity to advantageously proceed with the game in relation to the left-hand player.

In another aspect of the invention, the game machine is preferably so configured that the supplementary information generator updates the gained object information constituting part of the supplementary information regarding the objects gained by the opponent player who plays one turn before the primary player in the prescribed playing order, and the second display controller displays the objects contained in the supplementary information thus updated in the sub-screen area.

This configuration enables the primary player to easily and quickly recognize the objects gained by the opponent player who plays one turn before the primary player in the prescribed playing order by separately displaying the gained object information regarding those objects in the sub-screen area. If applied to a mahjong game, for example, this configuration serves to display the objects (tile objects) representing tiles of the left-hand player as if arranged in a vertical direction (which differs from an ordinary viewing direction) in the main screen area and supplementarily display the same objects as if arranged in a horizontal direction in the sub-screen area on the primary player's display device. Consequently, the primary player can easily and quickly recognize the objects representing the tiles of the left-hand player with no unnaturalness in appearance.

In still another aspect of the invention, the supplementary information preferably includes forecast information regarding conditions that enable the opponent player who plays one turn before the primary player in the prescribed playing order to reach a game winning state.

If applied to a mahjong game, for example, this arrangement enables the primary player to efficiently obtain information useful for analyzing the left-hand player's game playing situation. Here, the conditions that enable the left-hand player to reach the game winning state refer to conditions to be satisfied to win the competitive game, that is, conditions to be satisfied by the left-hand player to reach an "agari" state (winning a hand) in a mahjong game, for example.

In yet another aspect of the invention, the forecast information regarding the conditions that enable the opponent player who plays one turn before the primary player to reach the game winning state is preferably presented as the number of at least one object needed to be gained by the opponent player to reach the game winning state.

If applied to a mahjong game, for example, this arrangement enables the primary player to efficiently obtain the information useful for analyzing the left-hand player's game playing situation.

In a further aspect of the invention, the forecast information regarding the conditions that enable the opponent player who plays one turn before the primary player to reach the game winning state is preferably presented in the form of an image of at least one object needed to be gained by the opponent player to reach the game winning state.

If applied to a mahjong game, for example, this arrangement enables the primary player to efficiently obtain the information useful for analyzing the left-hand player's game playing situation.

What is claimed is:

1. A game machine provided with a display device which displays an image including an object, and an operating device which permits a primary player to specify and manipulate a desired object, said game machine being configured to carry out a competitive game by transmitting and receiving operational information through communications to and from another game machine having an operating device operated an opponent player, said game machine comprising:

a game progress controller for advancing the competitive game by accepting operational information entered from said operating device operated by the primary player as well as operational information entered from the other game machine operated by the opponent players and thereby obtaining a successively specified object for each player, respectively;

a first display controller for defining an arrangement zone where the specified object for each player is arranged in a plurality of regions within a main screen area of said display device, displaying the specified object for each player in such a manner that a pattern of the object is visually recognizable, and varying the on-screen appearance of the specified objects as the respective players gain the objects during the progress of the competitive game;

a supplementary information generator for generating supplementary information regarding the specified object of the primary player that is displayed in such a manner that the pattern is visually recognizable from gained object information regarding the specified object acquired by said game progress controller;

a second display controller for displaying the supplementary information in a sub-screen area located adjacent to the main screen area; and a communication device for receiving the operational information regarding operations entered through the operating device of the other game machine; and wherein said first display controller displays objects obtained by all players at the beginning of the competitive game in such a manner that the respective patterns of the obtained objects are visually recognizable;

wherein said first display controller displays an object which has been gained and substituted for another object of the opponent player during the progress of the competitive game in such a manner that the pattern of the gained object is visually unrecognizable;

wherein said first display controller displays the object obtained by the primary player at the beginning of the competitive game in the main screen area in a first presentation mode of displaying said primary player obtained object in a visually recognizable fashion, and displays an object subsequently gained by the primary player during the progress of the competitive game in the main screen area in a second presentation mode, different from the first presentation mode, of displaying the subsequently gained object in the visually recognizable fashion;

wherein the supplementary information generator generates supplementary information including information concerning the first and second presentation modes for the primary player, the supplementary information showing how the primary player obtained object is displayed on the main screen area of the game machine of the opponent player; and wherein said secondary display controller allows based on the supplementary information the pattern of the primary player obtained object that is displayed in the first presentation mode in the main screen area to be displayed in the sub-screen area in such a manner that the pattern of the primary player obtained object is visually recognizable, and allows the pattern of the subsequently gained object that is displayed in the second presentation mode in the main screen area to be displayed in the sub-screen area in such a manner that the pattern of the subsequently gained object is visually unrecognizable.

2. The game machine according to claim 1, wherein said first display controller defines the arrangement zone for the objects of the primary player in a lower part of the main screen area, defines the arrangement zones for the objects of the opponent players in upper, left and right parts of the main screen area in accordance with a playing order of the individual opponent players relative to the primary player, and displays the objects of the opponent players in the upper, left and right arrangement zones thus defined in such a manner that the objects are arranged widthwise.

3. The game machine according to claim 1, wherein said second display controller displays the objects whose patterns are visually recognizable and the objects whose patterns are visually unrecognizable in two mutually distinguishable groups.

4. The game machine according to claim 1, wherein the supplementary information includes a number of the objects whose patterns are visually recognizable.

5. A game information display method used by a game machine provided with a display device which displays an image including an operating device which permits a primary player to specify and manipulate a desired object, said game machine being configured to carry out a competitive game by transmitting and receiving operational information through communications to and from another game machine having an operating device operated by an opponent player, said game machine comprising a game progress controller, a first display controller, a supplementary reformation generator and a second display controller, said game information display method comprising the steps of:

causing said game progress controller to advance the competitive game by accepting the operational information entered from said operating device operated by the primary player as well as the operational information entered from the other game machine operated by the opponent player, and thereby obtaining successively specified objects for the individual players;

causing said first display controller to define an arrangement zone where the specified object for each of the players is arranged in each one of a plurality of regions within a main screen area of said display device, display the specified object for each of the primary player and the opponent player in such a manner that a pattern of the object for each said player is visually recognizable, and vary the on-screen appearance of the specified objects as the respective players gain the objects during the progress of the competitive game;

causing said supplementary information generator to generate supplementary information regarding the object of the primary payer that is displayed in such a manner that the pattern is visually recognizable from gained object information regarding the gamed objects acquired by said game progress controller; and causing said second display controller to display the supplementary information in a sub-screen area located adjacent to the main screen area; and wherein said first display controller displays objects obtained by all players at the beginning of the competitive game in such a manner that the respective patterns of the obtained objects are visually recognizable;

wherein said first display controller displays an object which has been gained and substituted for another object of the opponent player during the progress of the competitive game in such a manner that the pattern of the gained object is visually unrecognizable;

wherein said first display controller displays the object obtained by the primary player at the beginning of the competitive game in the main screen area in a first presentation mode of displaying said primary player obtained object in a visually recognizable fashion, and displays an object subsequently gained by the primary player during the progress of the competitive game in the main screen area in a second presentation mode, different from the first presentation mode, of displaying the subsequently gained object in the visually recognizable fashion;

wherein the supplementary information generator generates supplementary information including information concerning the first and second presentation modes for the primary player, the supplementary information showing how the primary player obtained object is displayed on the main screen area of the game machine of the opponent player; and wherein said secondary display controller allows based on the supplementary information the pattern of the primary player obtained object that is displayed in the first presentation mode in the main screen area to be displayed in the sub-screen area in such a manner that the pattern of the primary player obtained object is visually recognizable, and allows the pattern of the subsequently gained object that is displayed in the second presentation mode in the main screen area to be displayed in the sub-screen area in such a manner that the pattern of the subsequently gained object is visually unrecognizable.

6. A game program used by a game machine provided with a display device which displays an image including an object, and an operating device which permits a primary player to specify and manipulate a desired object, said game machine being configured to carry out a competitive game by transmitting and receiving operational information through communications to and from another game machine having an operating device operated by an opponent player under the control of a computer which is controlled by said game program to function as:

a game progress controller for advancing the competitive game by accepting operational information entered from said operating device operated by the primary player as well as operational information entered from the other game machines machine operated by the opponent player and thereby obtaining a successively specified object for each player, respectively;

a first display controller for defining an arrangement zone where the specified object for each player is arranged in a plurality of regions within a main screen area of said display device, displaying the specified object for each player in such a manner that a pattern of the object is visually recognizable, and varying the on-screen appearance of the specified objects as the respective players gain the specified objects during the progress of the competitive game;

a supplementary information generator for generating supplementary information regarding the object of the primary player that is displayed in such a manner that the pattern is visually recognizable from gained object information regarding the object acquired by said game progress controller;

a second display controller for displaying the supplementary information in a sub-screen area located adjacent to the main screen area; and a communication device for receiving the operational information regarding operations entered through the operating device of the other game machine; and wherein said first display controller displays objects obtained by all players at the beginning of the competitive game in such a manner that the respective patterns of the obtained objects are visually recognizable;

wherein said first display controller displays an object which has been gained and substituted for another object of the opponent player during the progress of the competitive game in such a manner that the pattern of the gained object is visually unrecognizable;

wherein said first display controller displays the object obtained by the primary player at the beginning of the competitive game in the main screen area in a first presentation mode of displaying said primary player obtained object in a visually recognizable fashion, and displays an object subsequently gained by the primary player during the progress of the competitive game in the main screen area in a second presentation mode, different from the first presentation mode, of displaying the subsequently gained object in the visually recognizable fashion;

wherein the supplementary information generator generates supplementary information including information concerning the first and second presentation modes for the primary player, the information showing how the primary player obtained object is displayed on the main screen area of the game machine of the opponent player; and wherein said secondary display controller allows based on the supplementary information the pattern of the primary player obtained object that is displayed in the first presentation mode in the main screen area to be displayed in the sub-screen area in such a manner that the pattern of the primary player obtained object is visually recognizable, and allows the pattern of the subsequently gained object that is displayed in the second presentation mode in the main screen area to be displayed in the sub-screen area in such a manner that the pattern of the subsequently gained object is visually unrecognizable.

7. A game machine provided with a display device which displays an image including an object, and an operating device which permits a primary player to specify and manipulate a desired object, said game machine being configured to carry out a competitive game by transmitting and receiving operational information through communications to and from another game machine having an operating device operated by an opponent player, said game machine comprising:

a game progress controller for advancing the competitive game by accepting operational information entered from said operating device operated by the primary player as well as operational information entered from the other game machine operated by the opponent player and thereby obtaining a successively specified object for each player, respectively;

a first display controller for defining an arrangement zone where the specified object for each player is arranged in a plurality of regions within a main screen area of said display device displaying the specified object for each player in such a manner that a pattern of the object is visually recognizable, and varying the on-screen appearance of the objects as the respective players gain objects during the progress of the competitive game;

a supplementary information generator for generating supplementary information regarding the object of the primary player that is displayed in such a manner that the pattern is visually recognizable from gained object information regarding the object acquired by said game progress controller;

a second display controller for displaying the supplementary information in a sub-screen area located adjacent to the main screen area;

wherein the supplementary information is information showing how the objects of the primary player are displayed on the main screen area of the opponent player;

wherein said first display controller allows the objects for the primary player horizontally in line in the main screen area and allows the objects for the opponent player who plays before the primary player in the prescribed playing order to be displayed vertically in line in the main screen area; and wherein said supplementary information generator updates the gained object information constituting part of the supplementary information regarding objects gained by the opponent player Who plays before the primary player in the prescribed playing order, and said second display controller allows the objects included in the supplementary information to be displayed horizontally in line in the sub-screen area.

8. The game machine according to claim 7, wherein the supplementary information includes forecast information regarding conditions that enable the opponent player who plays one turn before the primary player in the prescribed playing order to reach a game winning state.

9. The game machine according to claim 8, wherein the forecast information regarding the conditions that enable the opponent player who plays one turn before the primary player to reach the game winning state is presented as the number of at least one object needed to be gained by the opponent player to reach the game winning state.

10. The game machine according to claim 8, wherein the forecast information regarding the conditions that enable the opponent player who plays one turn before the primary player to reach the game winning state is presented in the form of an image of at least one object needed to be gained by the opponent player to reach the game winning state.

* * * * *